US007184697B2

(12) United States Patent
Kinouchi et al.

(10) Patent No.: US 7,184,697 B2
(45) Date of Patent: Feb. 27, 2007

(54) FIXING APPARATUS HAVING AN INDUCTION HEATING CONTROL CIRCUIT

(75) Inventors: Satoshi Kinouchi, Tokyo (JP); Osamu Takagi, Chofu (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 120 days.

(21) Appl. No.: 10/945,395

(22) Filed: Sep. 21, 2004

(65) Prior Publication Data

US 2006/0062609 A1 Mar. 23, 2006

(51) Int. Cl.
*G03G 15/20* (2006.01)

(52) U.S. Cl. ..... 399/328; 219/216

(58) Field of Classification Search ..... None
See application file for complete search history.

(56) References Cited

U.S. PATENT DOCUMENTS

| | | | | |
|---|---|---|---|---|
| 5,752,150 | A | 5/1998 | Kato et al. | |
| 6,026,273 | A | 2/2000 | Kinouchi et al. | |
| 6,078,781 | A | 6/2000 | Takagi et al. | |
| 6,087,641 | A | 7/2000 | Kinouchi et al. | |
| 6,097,926 | A | 8/2000 | Takagi et al. | |
| 6,137,985 | A | 10/2000 | Kinouchi et al. | |
| 6,154,629 | A | 11/2000 | Kinouchi et al. | |
| 6,337,969 | B1 | 1/2002 | Takagi et al. | |
| 6,415,128 | B1 | 7/2002 | Takagi et al. | |
| 6,438,335 | B1 | 8/2002 | Kinouchi et al. | |
| 6,643,476 | B1 | 11/2003 | Kinouchi et al. | |
| 6,643,491 | B2 | 11/2003 | Kinouchi et al. | |
| 6,724,999 | B2 | 4/2004 | Kikuchi et al. | |
| 6,725,000 | B2 | 4/2004 | Takagi et al. | |
| 6,763,206 | B2 | 7/2004 | Kinouchi et al. | |
| 2003/0215255 | A1* | 11/2003 | Kinouchi et al. | 399/69 |
| 2003/0219271 | A1 | 11/2003 | Kinouchi et al. | |
| 2004/0141038 | A1 | 7/2004 | Takagi et al. | |
| 2004/0188421 | A1 | 9/2004 | Takagi et al. | |
| 2004/0188422 | A1 | 9/2004 | Wasai et al. | |
| 2004/0238531 | A1 | 12/2004 | Kikuchi et al. | |
| 2004/0265021 | A1 | 12/2004 | Kinouchi et al. | |
| 2005/0008413 | A1 | 1/2005 | Takagi et al. | |

FOREIGN PATENT DOCUMENTS

| | | | |
|---|---|---|---|
| JP | 9-80951 | A | 3/1997 |
| JP | 2002-34241 | A | 1/2002 |

(Continued)

OTHER PUBLICATIONS

U.S. Appl. No. 10/387,413, filed Mar. 14, 2003, Kinouchi et al.

(Continued)

*Primary Examiner*—Quana Grainger
(74) *Attorney, Agent, or Firm*—Foley & Lardner LLP

(57) ABSTRACT

A fixing apparatus according to an embodiment of the present invention has a plurality of coils which are independently controlled by an inverter circuit. These coils have shapes to make the difference between the frequencies of the flowing high-frequency current out of an audible frequency range, preventing interference noise.

20 Claims, 18 Drawing Sheets

FOREIGN PATENT DOCUMENTS

| | | | | |
|---|---|---|---|---|
| JP | 2002-124369 | A | | 4/2002 |
| JP | 2004-20776 | A | | 1/2004 |
| JP | 2004037775 | A | * | 2/2004 |

OTHER PUBLICATIONS

U.S. Appl. No. 10/382,846, filed Mar. 7, 2003, Kinouchi et al.
U.S. Appl. No. 10/390,645, filed Mar. 19, 2003, Takagi et al.
U.S. Appl. No. 10/378,859, filed Mar. 5, 2003, Sone et al.
U.S. Appl. No. 10/378,865, filed Mar. 5, 2003, Tsueda et al.
U.S. Appl. No. 10/805,514, filed Mar. 22, 2004, Kinouchi et al.
U.S. Appl. No. 10/944,707, filed Sep. 21, 2004, Sone et al.
U.S. Appl. No. 10/944,855, filed Sep. 21, 2004, Sone et al.
U.S. Appl. No. 10/820,138, filed Apr. 8, 2004, Sone et al.
U.S. Appl. No. 10/805,305, filed Mar. 22, 2004, Sone et al.
U.S. Appl. No. 10/805,420, filed Mar. 22, 2004, Sone et al.
U.S. Appl. No. 10/799,770, filed Mar. 15, 2004, Kikuchi et al.
U.S. Appl. No. 10/805,507, filed Mar. 22, 2004, Kikuchi et al.
U.S. Appl. No. 10/805,522, filed Mar. 22, 2004, Kikuchi et al.
U.S. Appl. No. 10/805,308, filed Mar. 22, 2004, Tsueda et al.

* cited by examiner

FIXING APPARATUS HAVING AN INDUCTION HEATING CONTROL CIRCUIT

BACKGROUND OF THE INVENTION

1. Field of the Invention

The present invention relates to a fixing apparatus, which is provided in an image forming apparatus, copier, printer, etc., to form images on a transfer material by using an electro photographic process, and fixes a developer on a transfer material to the transfer material.

2. Description of the Related Art

In a copier or printer using an electronic process, it is known that a toner image formed on a photoconductor drum is transferred to a transfer material, and then the toner image fused by a fixing apparatus including a heating roller and a pressing roller is fixed to the transfer material.

In recent years, as a heating method of heating a heating roller, it is known that a heating member made of a heat-resistant film material having a thin metal layer (a conductor film) with a small heat capacity is shaped like an endless belt or a cylinder (a roller) and brought into contact with a fixing material by using induction heating. Compared with a heating method using a lamp or the like, in this method, the response to temperature changes in the heating roller is improved, the temperature is increased rapidly, and the warm-up time is reduced.

It is also known that an induction heater using induction heating includes a plurality of coils arranged in the length direction of a heating roller, and heats a predetermined area of the heating roller selected according to the size and other conditions of a fixing paper sheet. The induction heater flows a high-frequency current in a plurality of coils to generate an electromagnetic wave, and flows the induced current caused by the electromagnetic wave to heat a heating roller by the Joule heat generated by the induced current. By controlling the frequency of the high-frequency current flowing in this coil, the surface temperature of the heating roller can be changed, and the heating roller can be heated to a preset temperature.

When a high-frequency current with a different frequency flows simultaneously in each coil, interference noise may be generated by the different operating frequencies of the coils.

As disclosed in Jpn Pat. Appln. KOKAI Publication No. 9-80951, a fixing apparatus which prevents noise by connecting a plurality of coils constituting an induction heating means in parallel to decrease the inductance of the coils, and making the oscillation frequency generated by a resonance condenser and coils out of an audible frequency band, has been known.

This fixing apparatus neither assumes the noise generated when each coil is independently driven, nor prevents interference noise generated when each coil is independently driven.

As disclosed in Jpn Pat. Appln. KOKAI Publication No. 2002-124369, it has been known that in an induction heater having a plurality of induction coils for heating a heating member by induction heating, a switching means for turning on/off the input to each induction coil, and an induction heating inverter by a control means for controlling the turning on/off of the switching means, the control means synchronizes with the switching operation to turn on/off the input to each induction coil, and obtains an on/off signal by pulse width modulation.

Further, as disclosed in Jpn Pat. Appln. KOKAI Publication No. 2002-34241, there is another known induction heater having a heating means including a plurality of coils, in which the control circuit of one channel controls and varies the turning on/off width, and the control circuit of the other channel effects control by using a control signal curtailed from the signal synchronized with the one channel, thereby preventing interference noise and reducing uneven heating.

The above induction heaters use a control circuit to keep the frequency of high-frequency current flowing in the coils constant. Thus, it requires double number of switching elements compared with a circuit using a semi-E class self-excited system. Therefore, the thermal loss of the switching elements is doubled, and the efficiency is decreased. Concretely, if the thermal loss of one switching element is about 4%, the thermal loss by the switching elements become about 8% in the disclosed induction heater, and the heating efficiency is bad compared with a circuit using a self-excited system.

Further, the disclosed induction heaters use a circuit having a constant frequency, and when a pulse is forcibly given, the load on an inverter is increased, and a current value may be exceeded or the largeness of power may become difficult to control.

In the curtailed control disclosed in the Jpn Pat. Appln. KOKAI Publication No. 2002-34241, when one frequency is lowered, the frequency of a coil itself may become an audible frequency range, and noise may be generated.

Further, as disclosed in Jpn Pat. Appln. KOKAI Publication No. 2004-20776, a fixing apparatus having an induction heating means for heating a heating roller and a pressing roller has been known.

This fixing apparatus has a circuit to control an induction heating means for heating a heating roller, and a circuit to control an induction heating means for heating a pressing roller. These control circuits are independently operated. Therefore, the cost of circuits is increased compared with a fixing apparatus having only one circuit to control an induction heating means for heating a heating roller.

BRIEF SUMMARY OF THE INVENTION

According to an aspect of the present invention, there is provided a fixing apparatus comprising:

a heating member having a conductive metal layer;

a pressing member to supply a pressure to the heating member;

an induction heater which includes a first coil placed outside the heating member, and a second coil which is placed outside the heating member and has an inductance different from the first coil, and heats the conductive metal layer of the heating member by induction heating; and an induction heating control circuit which includes a first self-excited inverter circuit to flow a high-frequency current having a first frequency range in the first coil, a second self-excited inverter circuit to flow a high-frequency current having a second frequency range in the second coil, and controls to flow a high-frequency current simultaneously in the first and second coils;

wherein the first frequency range is not equal to the second frequency range.

According to another aspect of the present invention, there is provided a fixing apparatus comprising:

a heating member having a conductive metal layer;

a pressing member to supply a pressure to the heating member;

an induction heater which includes a first coil placed outside the heating member, and a second coil which is placed outside the heating member and has a load resistance equal to the inductance of the first coil, and heats the conductive metal layer of the heating member by induction heating; and an induction heating control circuit which includes a first self-excited inverter circuit to flow a high-frequency current in the first coil, a second self-excited inverter circuit to flow a high-frequency current in the second coil, and controls to flow a high-frequency current with substantially equal frequency simultaneously in the first and second coils.

According to further aspect of the present invention, there is provided a fixing apparatus comprising:

a heating member having a conductive metal layer;

a pressing member to supply a pressure to the heating member;

an induction heater which includes a first coil placed outside the heating member, and a second coil placed outside the heating member, and heats the conductive metal layer of the heating member by induction heating; and an induction heating control circuit which includes a first self-excited inverter circuit to flow a high-frequency current in the first coil, a second self-excited inverter circuit to flow a high-frequency current in the second coil, and controls to flow a high-frequency current with substantially equal frequency simultaneously in the first and second coils;

wherein when a high-frequency current flows simultaneously in the first and second coils, the power supplied to the first coil is equal to the power supplied to the second coil.

According to another aspect of the present invention, there is provided a fixing apparatus comprising:

a heating member having a conductive metal layer;

a pressing member which has a conductive metal layer, and supplies a pressure to the heating member;

a first induction heater which includes a first coil placed outside the heating member, and a second coil arranged in rows at one end of the first coil, a third coil arranged in rows at the other end of the first coil and connected in series with the second coil, and heats the conductive metal layer of the heating member by induction heating;

a second induction heater which includes a fourth coil placed outside the pressing member and connected in series with the second and third coils, and heats the conductive metal layer of the pressing member by induction heating; and an induction heating control circuit which includes a first self-excited inverter circuit to flow a high-frequency current in the first coil, second and third coils connected in series, and a second self-excited inverter circuit which flows a high-frequency current in the fourth coil.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION (Embodiment 1)

Description will be given on an example of a fixing apparatus according to embodiments of the present invention hereinafter with reference to the accompanying drawings.

Figure 1:
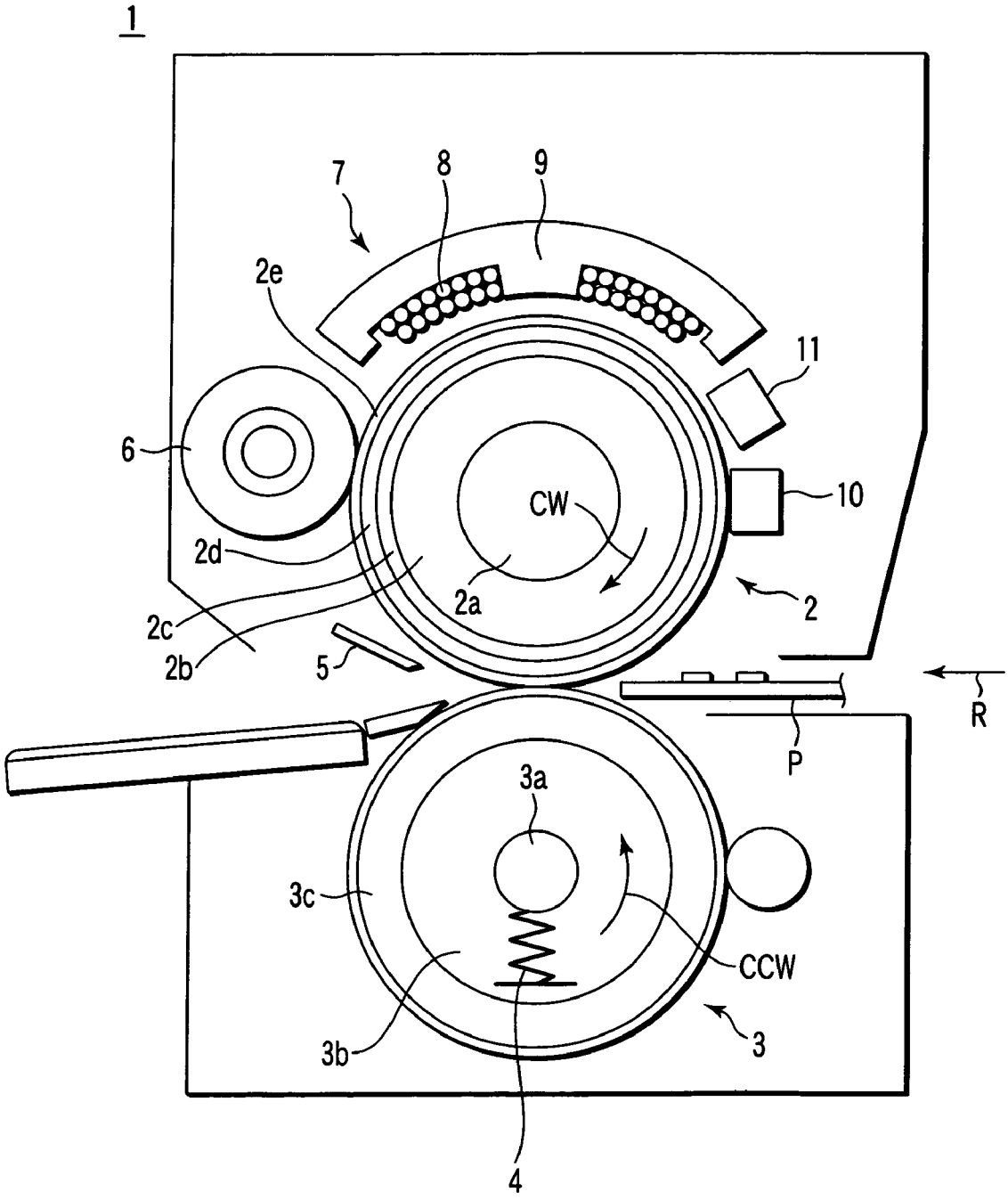
FIG. 1 is a schematic diagram explaining an example of a fixing apparatus according to a first embodiment of the present invention.
Figure 2:
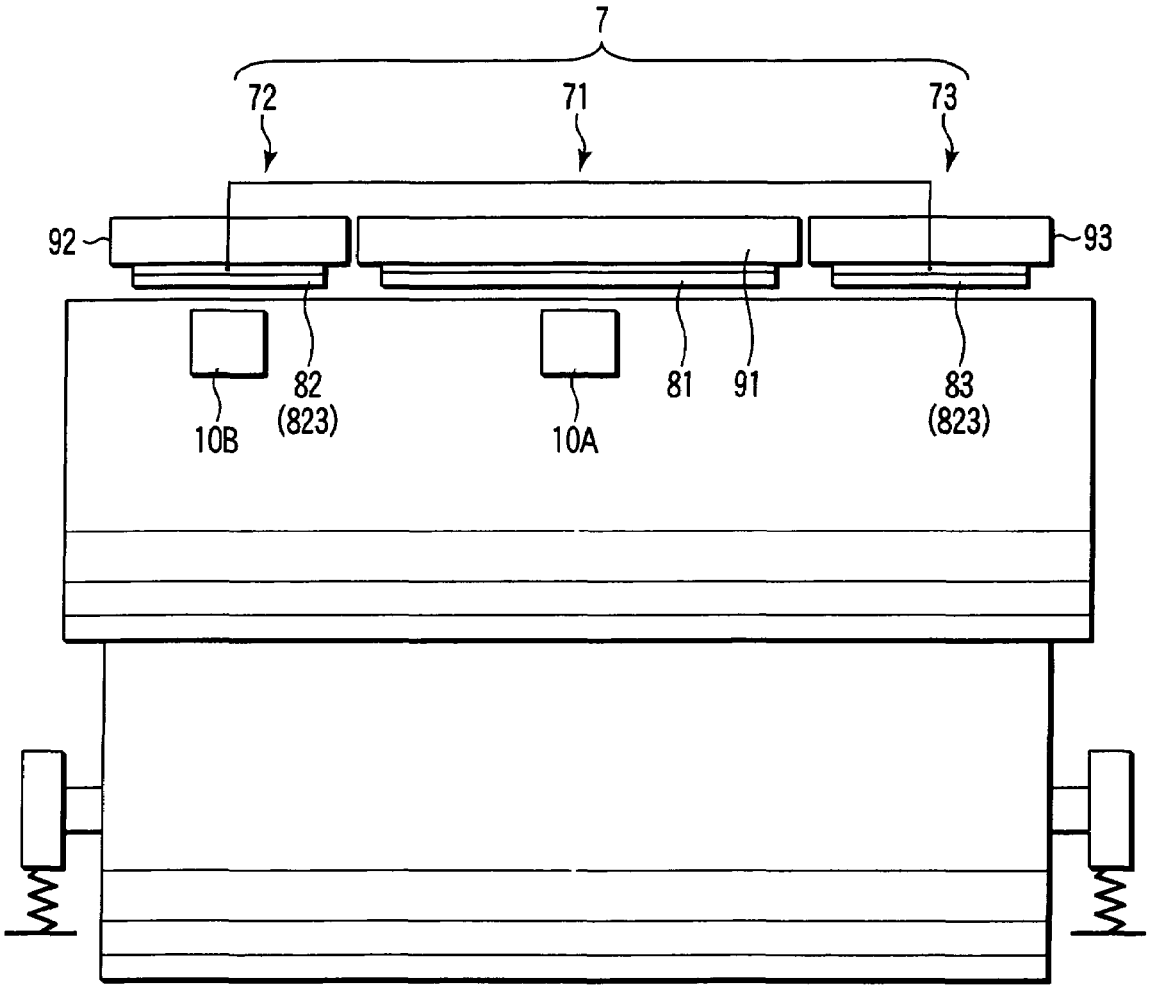
FIG. 2 is a schematic diagram of the fixing apparatus shown in FIG. 1 viewed from the arrow R direction.

FIG. 1 is a schematic diagram explaining an example of a fixing apparatus according to an embodiment of the present invention. FIG. 2 is a schematic diagram of the fixing apparatus shown in FIG. 1 viewed from the arrow R direction.

As shown in FIGS. 1 and 2, a fixing apparatus 1 has a heating member (a heating roller) 2, a pressing member (a pressing roller) 3, a pressing spring 4, a peel-off claw 5, a cleaning roller 6, an induction heater 7, a temperature detection mechanism 10, and a thermostat 11.

The heating roller 2 has a shaft 2*a* made of material with the rigidity (hardness) not deformed by a given pressure, elastic layers (a foam rubber layer, a sponge layer and a silicone a rubber layer) 2*b* provided sequentially around the shaft 2*a*, a metal member (a conductive metal layer) 2*c*, a solid rubber layer 2*d* and a mold releasing layer 2*e*. The solid rubber layer 2*d* and mold releasing layer 2*e* are made of a thin film such as a heat-resistant silicone a rubber. In this embodiment, the length of the heating roller 2 is 330 mm.

The conductive metal layer 2*c* is made of conductive material (e.g., nickel, stainless steel, aluminum, copper, and aluminum-stainless steel compound material).

It is desirable to form the foam rubber layer 2*b* 5–10 mm thick, conductive metal layer 2*c* 10–100 μm thick, solid rubber layer 100–200 μm thick, respectively. In this embodiment, the foam rubber layer 2*b* is 5 mm thick, the conductive metal layer 2*c* is 40 μm thick, the solid rubber layer is 200 μm thick, and the mold releasing layer is 30 μm thick, respectively. The heating roller 2 has the diameter of 40 mm. The heating roller 2 is not limited to the configuration and size of this embodiment, and may be configured to have a core metal made of magnetic material and a mold releasing layer provided outside the metal core.

The pressing roller 3 includes a metal core 3*a* that is a metal shaft (with a high rigidity) not deformed by a give pressure, a silicone rubber 3*b* and fluorine rubber 3*c* provided around the metal core 3*a*. The pressuring roller has the diameter of 40 mm in this embodiment. The pressing roller 3 of this invention is not limited to the configuration of this embodiment, and may be an elastic roller having a conductive metal layer and an elastic layer like the heating roller 2.

The pressing spring 4 is pressed to the axis line of the heating roller 2 by a given pressure. The pressing roller 3 is kept substantially parallel to the axis line of the heating roller 2.

Thus, a nip with a given width is formed between the heating roller 2 and the pressing roller 3.

The heating roller 2 is rotated by a motor in the arrow CW direction at a substantially constant speed. The pressing roller 3 is pressed to the heating roller 2 by a given pressure of the pressing spring 4, and rotated in the direction (in the arrow CCW direction) reverse to the heating roller 2 at the position contacting the heating roller 2.

The peel-off claw 5 is located on the circumference of the heating roller 2, and peels off a paper sheet P from the heating roller 2 in the downstream side of the heating roller 2 rotated by the nip formed by the heating roller 2 and the pressing roller 3 contacting each other, at a given position near the nip, when the paper sheet P passes through the nip. The invention is not limited to the configuration of this embodiment. Two or more peel-off claws 5 may be provided, When there is lot of developer to be fixed to a paper sheet like in forming a color image, and a paper sheet is difficult to be peel off from the heating roller 2. The peel-off claw may be omitted, when a paper sheet is easy to peel off from the heating roller 2.

The cleaning roller 6 eliminates toner and paper dust remained on the surface of the heating roller 1.

The induction heater 7 is provided outside the heating roller 2, and has at least two heating coils (exciting coil) 8 that is supplied with a given power and supplies a given magnetic field to the heating roller 2. A predetermined power is supplied to the heating coil, and the heating roller 2 is heated to a given temperature by induction heating. The coil 8 has a magnetic material core 9. Thus, the number of windings (turns) of the coil 8 can be reduced. The magnetic material core 9 can collectively generate a magnetic flux. Thus, the induction heater 7 can locally heat a given area of the heating roller 2.

Detailed explanation will now be given with reference to FIG. 2. The induction heater 7 includes a coil body 71 which is placed opposite to the center portion in the axial direction of the heating roller 2 and supplies a magnetic field to the center portion of the heating roller 2, and coil bodies 72 and 73 which are placed opposite to the end portion in the axial direction of the heating roller 2 and supplies a magnetic field to the end portion of the heating roller 2. The coil body 71 includes a center coil 81 and a magnetic material core 91. The coil body 72 includes an end coil 82 and a magnetic material core 92. The coil body 73 includes an end coil 83 and a magnetic material core 93. The end coils 82 and 83 are electrically connected in series, forming one end coil 823. In this embodiment, the coil bodies 71, 72 and 73 are arranged at intervals of 20 mm or less to prevent a temperature decrease between the coil bodies of the heating roller 2.

The temperature detection mechanism 10 detects temperatures at several portions on the outer circumference of the heating roller 2 to detect a temperature difference in the axial direction of the heating roller 2. Detailed explanation will now be given with reference to FIG. 2. The temperature detection mechanism 10 includes a thermistor 10A to detect the temperature of the outer circumference area of the heating roller 2 heated by the coil body 71, and a thermistor 10B to detect the temperature of the outer circumference area of the heating roller 2 heated by the coil body 72.

As shown in FIG. 1, the thermostat 11 detects abnormal heating which causes an abnormal temperature increase in the surface of the heating roller 2, and shuts off the power supplied to the coil 8 of the induction heater 7 when abnormal heating occurs. The thermostat 11 is preferably provided at least more than one near the surface of the heating roller 2, and may be provided near the pressing roller 3.

It is also permitted to provide near the circumference of the pressing roller a peel-off claw which peels off the paper sheet P from the pressing roller 3, and a cleaning roller which eliminates the toner adhered to the circumference surface of the pressing roller 3.

The paper sheet P which holds a toner T passes through the nip formed between the heating roller 2 and the pressing roller 3, where a fused toner T is pressed to the paper sheet P and an image is fixed.

Figure 3:
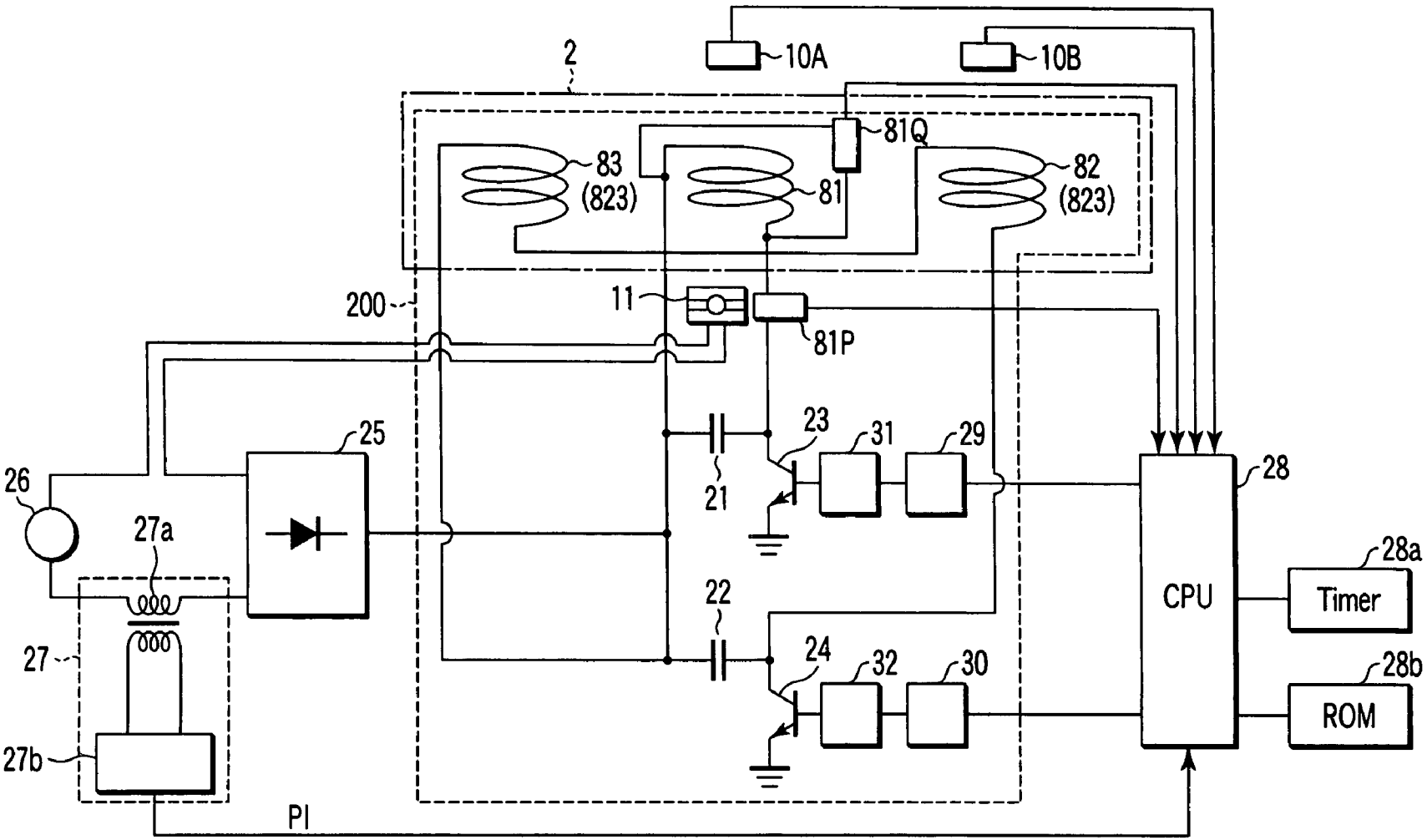
FIG. 3 is a block diagram explaining the control system of the fixing apparatus shown in FIG. 1.

Referring now to FIG. 3, the configuration of an induction heating control circuit applicable to the fixing apparatus shown in FIG. 1 and a method of operating the fixing apparatus 1 will be explained. The induction heating control circuit has a coil current control circuit 200, a rectifier circuit 25, a commercial AC power supply 26, an input power monitor 27, and a CPU 28. The commercial AC power supply 26 is a power source to supply the fixing apparatus 1 with an operating power, which is a part of the power supplied to a copier or the like provided with the fixing apparatus 1.

The coil current control circuit 200 includes the coils 81, 82 and 83.

The circuit including the coil 81 has a current detector 81P and a voltage detector 81Q. The outputs from the current detector 81P and voltage detector 81Q are applied to the CPU 28. Based on the input values, the CPU 28 calculates the power of the coil 81. By subtracting the power of the coil 81 calculated by the CPU 81 from the value of the input power monitor 27, the power generated in the circuit including the coils 82 and 83 can be obtained. With this circuit configuration, it is possible to control the power generated in the coils of the CPU 81 not to exceed the power distributed to the fixing apparatus. In this embodiment, the current detector and voltage detector are provided only in the circuit including 81, but they can also be provided in the circuits including the coils 82 and 83.

A first resonance circuit includes the center coil 81 and resonance condenser 21 connected in parallel. A first inverter circuit includes the first resonance circuit and the switching element 23 connected in series. A second resonance circuit includes the end coil 823 and resonance condenser 22 connected in parallel. As described above, the end coil 823 is electrically one coil connected in series with the end coils 82 and 83. A second inverter circuit includes the second resonance circuit and the switching element 24 connected in series. As the switching elements 23 and 24, IGBT or MOS-FET operable with high withstand voltage and large current can be used. IGBT is used in this embodiment.

The first and second inverter circuits are supplied with the DC current smoothed by the rectifier circuit 25 and supplied from the commercial ac power supply 26. Between the rectifier circuit 25 and commercial AC power supply 26, the thermostat 11 and the input power monitor 27 for monitoring the input power PI or the product of the current and voltage supplied from the commercial ac power supply are connected.

The input power monitor 27 includes a transformer 27*a* connected to the commercial AC power supply 26, and an input power detection circuit 27*b* to detect the input power PI sent from the transformer 27*a*. The input power detection circuit 27*b* is connected to the CPU 28, and gets feedback of the information about the input power PI detected by the transformer.

The CPU 28 is connected to a timer 28*a*, a ROM 28*b*, a control circuit 29 and a control circuit 30, outputs a signal including the information about the driving frequency to the control circuits 29 and 30, and totally controls the fixing apparatus 1. The control circuits 29 and 30 are connected to driving circuits 31 and 32, respectively. The driving circuit 31 is connected to the control terminal of the switching element 23. The driving circuit 32 is connected to the control terminal of the switching element 24.

The control circuits 29 and 30 control the timing of supplying power to the coils 81–83. The driving circuits 31 and 32 turns on/off the switching elements 23 and 24 according to the timing or the driving frequency specified by the control circuits 29 and 30. When the switching elements 23 and 24 are turned on, a current flows in the coils 81–83. The duration at this time is the ON time. When the switching elements 23 and 24 are turned off after the ON time elapses, a resonance current flows between the center coil 81 and condenser 21, or between the end coils 82, 83 and condenser 22. Explaining in detail, the current flowing in the first and second inverter circuits charges the condensers 21 and 22 immediately after the ON time, and then the condensers are discharged and the voltage is lowered to near zero. The CPU 28 detects that the voltage is lowered to near zero, and instructs the control circuits 29 and 30 to turn on the switching elements 23 and 24. By repeating the above switching cycle, a high-frequency current flows in the coils 81–83.

The frequency of the high-frequency current flowing in the coils 81–83 is determined by the ON time of the switching elements 23 and 24 controlled by the CPU 28, taking the total of the ON and OFF time of the switching element 23 or 24 as one cycle. Hereinafter, the frequency determined by the ON time of the switching elements 23 and 24 controlled by the CPU 28 is considered a driving frequency, and the frequency of the high-frequency current flowing in the coils 81–83 is considered an operating frequency.

The self-excited inverter circuit used in this embodiment has the characteristic that the OFF time varies minutely according to an object (a load) that is given a magnetic field and heated. As described above, a load is only one, the heating roller 2, in this invention, and a current having the same operating frequency as the driving frequency flows in the coils 81–83. However, in a coil having two or more loads, the operating frequency of a current flowing in the coils or loads may be different from the driving frequency. Thus, when a current is supplied to the coils, even if the difference between the controlled driving frequencies is out of an audible frequency range, the difference between the operating frequencies of the current flowing in the coils may not be out of an audible frequency range, and an interference sound is generated. Therefore, when there is two or more loads to heat, it is difficult to determine the operating frequency of the current flowing in the coils according to the driving frequency.

The magnitude of the power supplied to the coils 81–83 is controlled by the ON time instructed by the control circuits 29 and 30, and changeable by controlling the ON time. In other words, the largeness of the power supplied to the coils 81–83 is changed by changing the information about the driving frequency included in the signal output from the CPU 28. In this embodiment, power of 600–1400 W is supplied to the coils 81–83. A high-frequency current of 20–100 kHz flows in the coils 81–83.

When the power supply of an apparatus provided with the fixing apparatus 1 is turned on, or when the fixing operation is continuously executed and the surface temperature of the heating roller 2 is lowered, it is required to heat and restore the surface temperature of the heating roller 2 to a given fixing temperature as soon as possible. For this purpose, the coils 81–83 are supplied with a maximum power of 1400 W. During the fixing operation, or while the paper sheet P is passing between the heating roller 2 and the pressing roller 3, the coils 81–83 are supplied with 900 W smaller than the maximum power, because certain power is used by other units such as a scanner and a photoconductor drum motor mounted in the apparatus provided with the fixing apparatus 1. In standby mode, the coils 81–83 are supplied with 600 W, because the power necessary to keep the temperature of the heating roller 2 constant is sufficient, and much power is not necessary.

In this embodiment, equal power is supplied to the center coil 81 and the end coil 823 comprising the end coils 82 and 83. Therefore, power of 300–700 W is supplied to the end coil 823 and center coil 81, respectively. The power supplied to these coils is referred to as an output power hereinafter. In this embodiment, the power supplied to the center coil 81 and end coils 82/83 is controlled based on the input values from the current detector 81P and voltage detector 81Q, so that the value of the input power monitor 27 becomes equal to the double of the power of the coil 81 detected by the CPU 28.

When a high-frequency current flow in the coils 81–83, the magnetic field generated from the coils 81–83 is supplied to the heating roller 2. Thus, an eddy current is generated in the heating roller 2, and the heating roller 2 is heated.

The surface temperature of the heated heating roller 2 is detected by the thermistors 10A and 10B, and output to the CPU 28 as a temperature detection signal (a voltage value). According to the temperature detection signal, the CPU 28 changes the ON time of the switching elements 23 and 23, and controls the value of supplied power.

Figure 4:
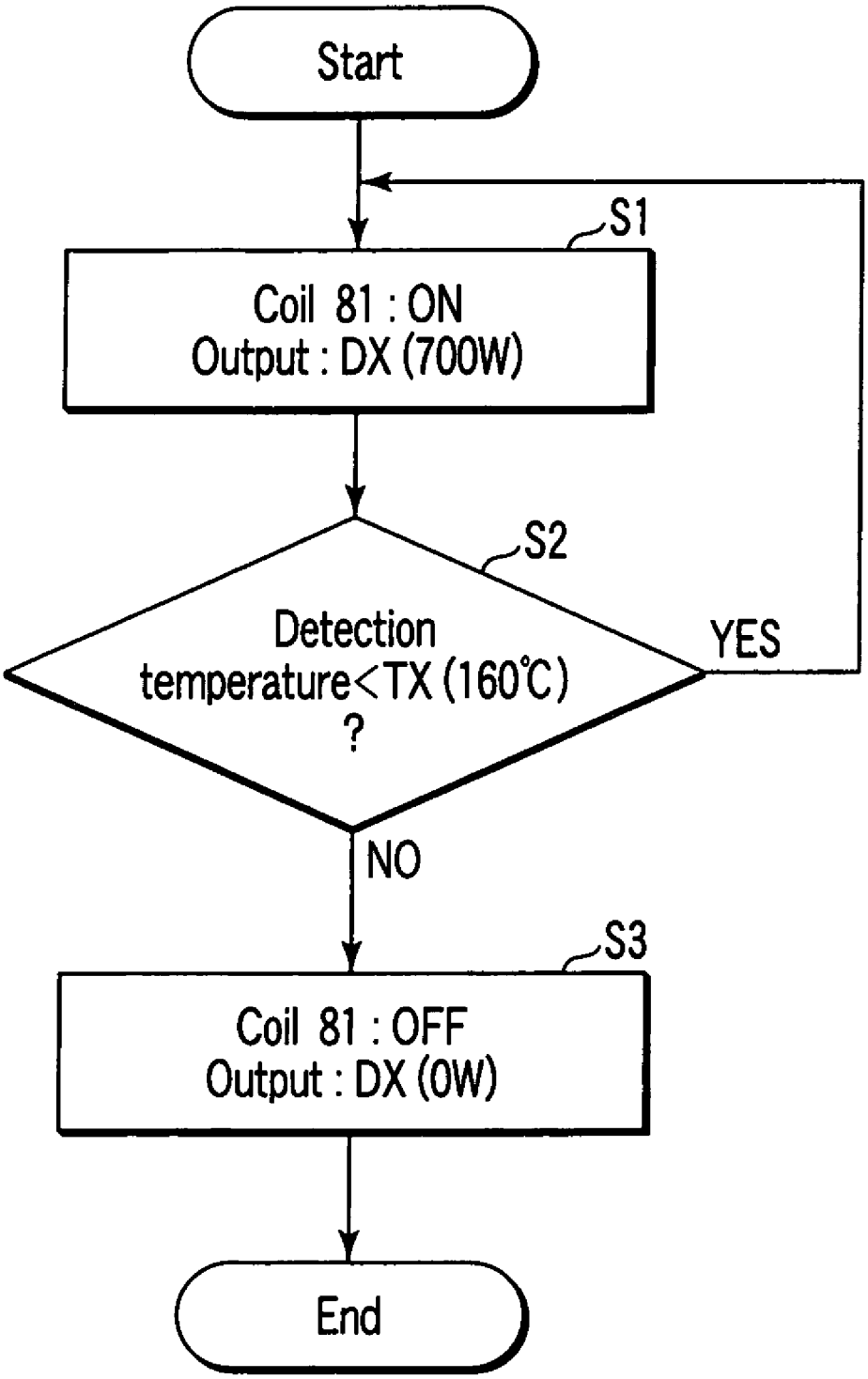
FIG. 4 is a flowchart explaining the warm-up control applicable to the fixing apparatus shown in FIG. 1.

FIG. 4 is a flowchart explaining the warm-up control applicable to the fixing apparatus shown in FIG. 1.

As shown in FIG. 4, when the power supply of a apparatus provided with the fixing apparatus 1 is turned on, that is, at warming up, the CPU 28 controls the control circuit 29 to supply power of 700 W to the center coil 81 as a power DX so that the surface temperature of the heating roller 2 becomes 160° as a control temperature TX (S1).

The CPU 28 compares the control temperature TX with the temperature at the center portion of the heating roller 2 heated by the center coil 81 and detected by the thermistor 10A (S2). If the temperature detected by the thermistor 10A is lower than the control temperature TX (S2—YES), the CPU returns to step S2, and supplies power of 700 W to the center coil 81, and compares the control temperature TX again with the temperature detected by the thermistor 10A.

If the temperature detected by the thermistor 10A is higher than the control temperature TX (S2—YES), the CPU turns off the switch element 23, and lowers the output to zero (S3). When the heating roller 2 reaches the control temperature TX as described above, the warming up is finished. Likewise, for the switching element 24, the control temperature of CPU 28 is compared with the temperature detected by the thermistor 10B, and the warming up is controlled.

When the warming up is finished, the surface temperature of the heating roller 2 is controlled by the ON/OFF control, for example, to be kept at a given fixing temperature. The ON/OFF control mentioned here is to adjust the timing and duration of turning on/off the switching element according to a temperature change in the heating roller 2 depending on the paper passing states, for example, the paper sheet P is continuously passed and the roller temperature is decreased, or the paper sheet P is not passed and the roller temperature is increased. The ON/OFF control is a method of controlling the temperature of the heating roller 2.

Therefore, the switching elements 23 and 24 are independently controlled by the control circuits 29 and 30, respectively, and operated in four patterns; turned on simultaneously, one turned on while the other turned off, and both turned off.

Explained in FIG. 4 is a method of comparing the control temperature TX directly with the detection temperature in step S2. But, if the detection sensitivity of the thermistor 10A is not good, the temperature detected by the thermistor 10A is deviated from the control temperature TX. In this case, it is possible to compare the detection temperature with the control temperature by adding respectively.

Next, description will be given on a method of controlling the induction heater 7 after the warming up with reference to FIG. 5.

Figure 5:
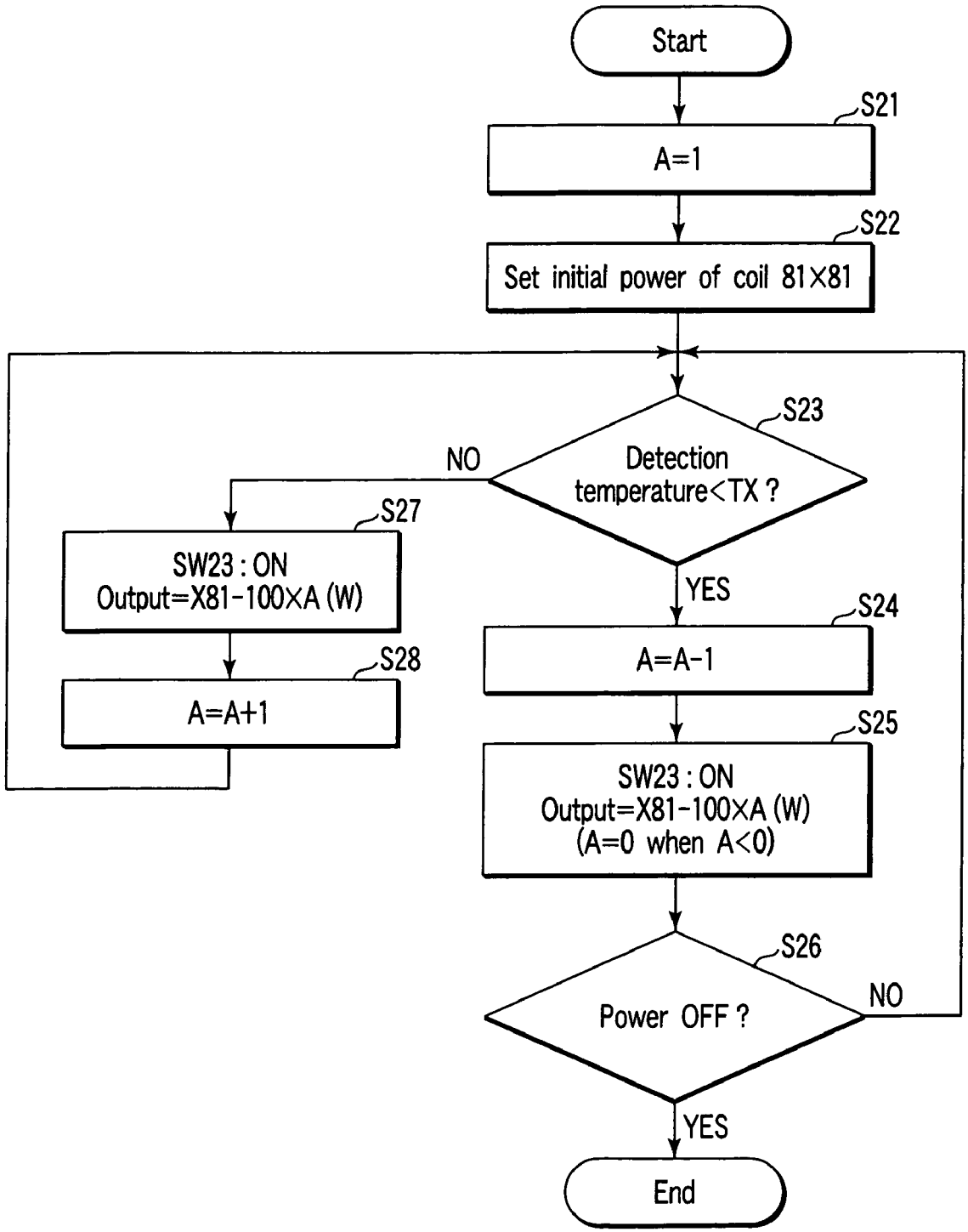
FIG. 5 is a flowchart explaining the variable power control applicable to the fixing apparatus shown in FIG. 1.

FIG. 5 is a flowchart explaining the variable power control applicable to the fixing apparatus shown in FIG. 1. Description will be given on control of the power supplied to the center coil 81.

Unlike the ON/OFF control, the variable power control explained hereinafter is a method of controlling the power supplied to the coils by adjusting the driving frequency specified by the driving circuit according to a temperature change in the heating roller 2 depending on the paper passing status. In this embodiment, the CPU 28 has a function to determine the output power based on the output power calculation formula "output power (W)=initial power×81−100×A" to adjust the output power value in response to a temperature change in the heating roller 2.

As shown in FIG. 5, the CPU 28 recognizes 1 as a coefficient A in the output power calculation formula (S21), and sets 550 W, for example, in the output power calculation formula as the initial power×81 set previously as an output power immediately after the end of warming up (S22). The detection temperature outputted from the thermistor 10A which detects the temperature of the center portion of the heating roller 2 is input, and the CPU 28 compares the detection temperature with the control temperature TX (S23). If the detection temperature is lower than the control temperature (S23—YES), the CPU 28 recognizes the value obtained by subtracting 1 from A=1 recognized in step S21, that is, zero as a new coefficient A to keep or increase the output power value supplied to the center coil 81 (S24). The CPU 28 calculates the output power based on the initial power×81=550 W and coefficient A=0, and instructs the driving circuit 31 to generate a driving frequency to supply the calculated output power to the center coil 81. Thus, the switching element SW23 is turned on, and power of 550 W is supplied to the center coil 81 (S25). If the power supply of an apparatus provided with the fixing apparatus 1, for example, an image forming apparatus and facsimile is turned off thereafter (S26—YES), the CPU 28 stops supplying power to the center coil 81, and finishes this control. If the power supply of the apparatus is not turned off, the CPU returns to step S23 and compares again the detection temperature with the control temperature TX.

If the detection temperature is lower than the control temperature, the CPU 28 recognizes the value obtained by subtracting 1 from the previously recognized coefficient A=0, or −1 as a new coefficient A in step S24. In step S25, if the coefficient A is less than zero, the CPU 28 recognizes all coefficients A as zero. Thus, the output power calculated by the output power calculation formula is 550 W as explained in step S25, and power of 550 W is supplied to the center coil 81 (S25). Therefore, the heating roller 2 is heated to reach the control temperature.

In contrast, as described above, the CPU 28 recognizes 1 as the coefficient A in the output power calculation formula (S21) immediately after the warming up, sets 550 W, for example, as the output power×8 (S22), and compares the control temperature TX with the detection temperature output from the thermistor 10A (S23). If the detection temperature is higher than the control temperature (S23—NO), the CPU 28 calculates the output power to reduce the value of output power supplied to the center coil 81, or to make it small.

The CPU 28 calculates the output power based on the initial power×81=550 W and coefficient A=1, and instructs the driving circuit 31 to generate a driving frequency to supply the calculated output power to the center coil 81. Thus, the switching element SW23 is turned on, and power of 550 W is supplied to the center coil 81 (S27). Thereafter, the CPU 28 recognizes the value obtained by adding 1 to the coefficient A=1, or 2 as a new coefficient A (S28), returns to step S23, and compares the control temperature TX with the detection temperature output from the thermistor 10A. If the detection temperature is higher than the control temperature (S23—NO), the CPU 28 calculates the output power based on the initial power×81=550 W and previously recognized coefficient A=2, and instructs the driving circuit 31 to generate a driving frequency to supply the calculated output power to the center coil 81. Thus, the switching element SW23 is turned on, and power of 350 W is supplied to the center coil 81 (S27).

Thereafter, the CPU 28 recognizes the value obtained by adding 1 to the coefficient A=2, or 3 as a new coefficient A (S28), returns again to step S23, and compares the control temperature TX with the detection temperature output from the thermistor 10A. If the detection temperature is lower than the control temperature (S23—YES), the CPU 28 recognizes the value obtained by subtracting 1 from A=3 recognized in step S28, or 2 as a new coefficient A (S24). The CPU 28 calculates the output power based on the initial power×81=550 W and coefficient A=2, and instructs the driving circuit 31 to generate a driving frequency to supply the calculated output power to the center coil 81. Thus, the switching element SW23 is turned on, and power of 350 W is supplied to the center coil 81 (S25).

Therefore, it is possible to control the power supplied to the coil by adjusting the driving frequency instructed to the driving circuit in response to a temperature change in the heating roller 2 according to the paper passing status.

The above variable power control is effective to prevent a temperature drop at the center portion of the heating roller 2 and an excessive temperature rise at the end of the heating roller, when a small-size paper sheet P is passed. Concretely, the control temperature for the center portion of the heating roller 2 is increased, and the control temperature for the end of the heating roller 2 is decreased. Thus, the heating roller 2 can be heated to a fixing temperature evenly in the axial direction.

Likewise, for the switching element 24, the control temperature TX of CPU 28 is compared with the temperature detected by the thermistor 10B, and the variable power control is applied. In this embodiment, the number to multiply the coefficient A is 100, but the number is not limited to this. Numbers smaller than 100 can be set when a gentler temperature change is desired.

Therefore, power may be supplied simultaneously to the coils 81–83, and a current with a different frequency may flow in the coils.

The coils 81–83 of this invention have the shape not to generate interference noise when different frequency current flows at the same time. Namely, the coils 81–83 are formed so that the difference between the frequencies of the current flowing in them at the same time becomes out of an audible frequency range.

Thus, in this embodiment, the operating frequency of the center coil 81 is in a range of 22–35 kHz, and the operating frequency of the end coils 82 and 83 is in a range of 57–75 kHz. Namely, the difference between the highest frequency (35 kHz) of the current flowing in the center coil 81 and the lowest frequency (57 kHz) of the current flowing in the end coils 82 and 83 is larger than an audible frequency range 20 kHz, and interference noise is not generated.

As shown in FIG. 3, this embodiment uses a low price self-excited inverter circuit. A self-excited inverter circuit is low price compared with a separately excited inverter circuit. However, as in this embodiment, when the first and second self-excited inverter circuits are used, the frequency of the current flowing in the coil 81–83 may be changed according to a temperature change in the coils 81–83 included in the first and second resonance circuits and a temperature change in the heating roller 2 that is a load (a heating object).

Figure 6:
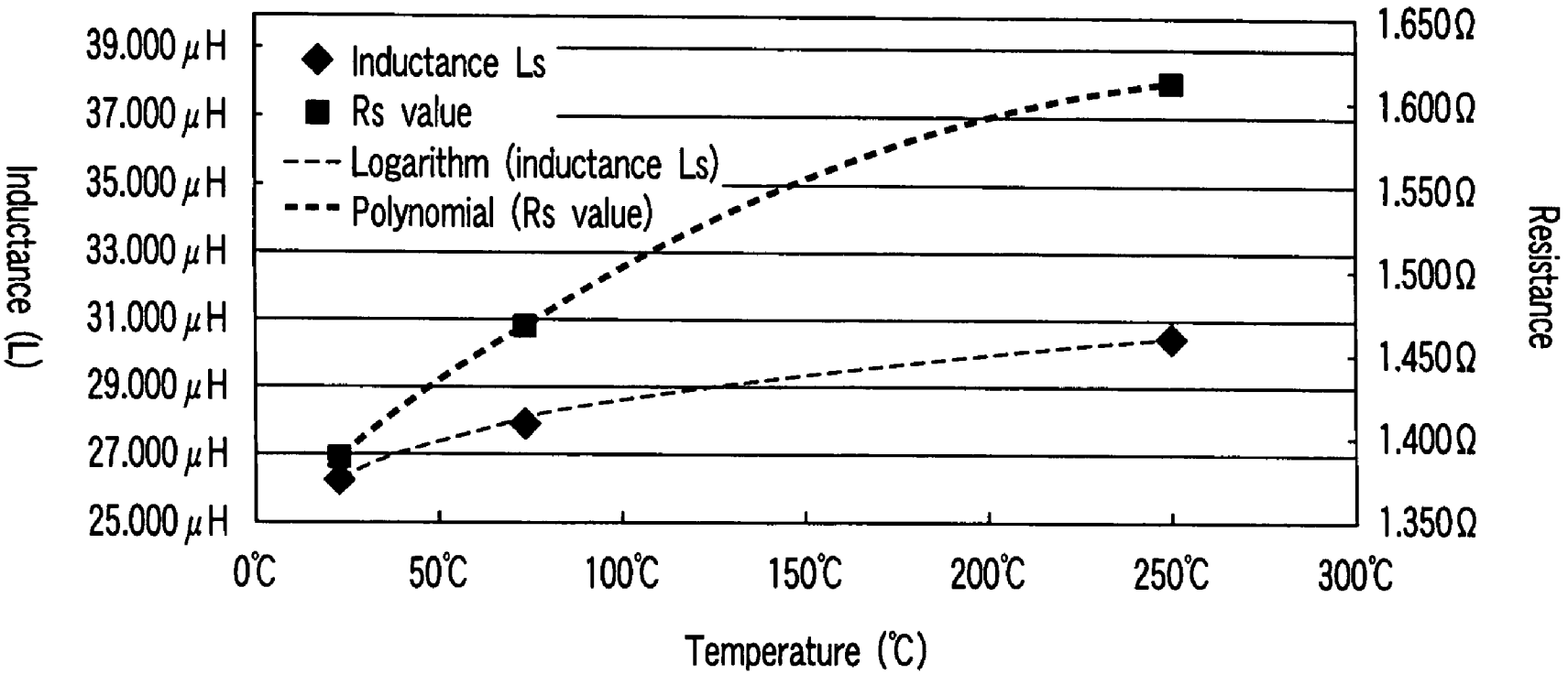
FIG. 6 is a reference graph explaining the changes in the inductance of coils caused by a temperature change, and the changes in the resistance value of a heating roller caused by a temperature change.

FIG. 6 shows the changes in the inductance of the coils 81–83 caused by a temperature change, and the changes in the resistance value of the heating roller 2 caused by a temperature change.

As shown in FIG. 6, the inductance increases as the temperatures of the coils 81–83 rise, and the resistance value increases as the temperature of the heating roller 2 rises.

The frequency F of the current flowing in the first and second resonance circuits (coils 81–83) is expressed by:

$$F\ (\mathrm{Hz}) = \frac{1}{2\pi\sqrt{LC}}$$

Therefore, the output frequency F flowing in the coils 81–83 decreases as the inductance increases or the temperature of the heating roller 2 rises. Thus, in this embodiment, the center coil 81 becomes the highest in the output frequency when the heating roller 2 is at a room temperature and the supplied power is the minimum. The end coils 82 and 83 become the lowest in the output frequency when the heating roller 2 is at a high temperature and the supplied power is the maximum.

Therefore, (1) the center coil 81 has the shape that the output frequency becomes 35 kHz or lower when the heating roller 2 is at a room temperature and the output power of 300 W is supplied, and (2) the end coils 82 and 83 have the shapes that the output frequency becomes 57 kHz or higher when the heating roller 2 is at a high temperature and the output power of 700 W is supplied. In this embodiment, when the heating roller is at a high temperature means when the control temperature controlled by the CPU 28 is 170°.

Figure 7:
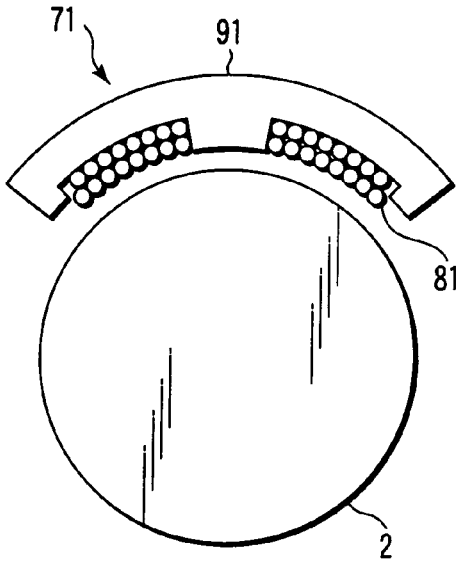
FIG. 7 shows cross sections of a coil body and a heating roller applicable to the fixing apparatus shown in FIG. 1.

Concretely, the center coil 81 explained in (1) is a coil fixed to the magnetic material core 91 and wound a coil wire by 16 turns, and as shown in FIG. 7. The magnetic material core 91 is curved along the circumferential surface of the heating roller 2. The center coil 81 is also curved along the magnetic material core 91. The magnetic material core 91 is formed just like surrounding the center coil 81 to prevent a leak of the magnetic flux generated from the center coil 81 to the outside of the heating roller 2. The core 91 is formed also to be placed at the center of the center coil 81, because the magnetic flux generated from the center coil 81 is concentrated.

The coil wire of the center coil 81 is a litz wire made by binding 16 insulation coated copper wires with the diameter of 0.5 mm, and covered with a heat-resistant polyamide-imide or the like. Therefore, as the copper wire diameter (0.5 mm) is made smaller that the depth of penetration, the alternating current flowing in the center coil 81 can be efficiently used.

Therefore, the center coil 81 has the shape to provide the output frequency of 35 kHz when the heating roller 2 is at a room temperature and output power of 300 W is supplied, and the output frequency of 22 kHz when the output power of 700 W is supplied.

Figure 8:
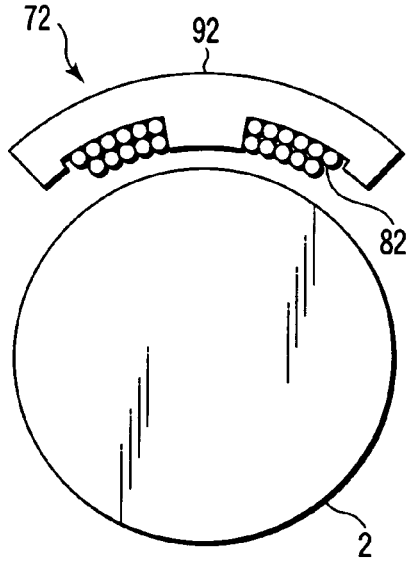
FIG. 8 shows cross sections of a coil body and a heating roller applicable to the fixing apparatus shown in FIG. 1.

The end coil 82 explained in (2) is a coil fixed to the magnetic material core 92 and wound a coil wire by 11 turns, and as shown in FIG. 8.

The magnetic material core 92 is curved along the circumferential surface of the heating roller 2. The end coil 82 is also curved along the magnetic material core 92. The magnetic material core 92 is formed just like surrounding the center coil 82 to prevent a leak of the magnetic flux generated from the center coil 82 to the outside of the heating roller 2. The core 92 is formed also to be placed at the center of the center coil 82, because the magnetic flux generated from the center coil 82 is concentrated. The magnetic material core 92 has the magnetic characteristics with the impedance smaller than that of the magnetic material core 91. The magnetic material core 93 of the end coil 83 has the configuration similar to the magnetic material core 92.

The coil wire of the center coil 82 is a litz wire made by binding 60 insulation coated copper wires with the diameter of 0.3 mm, and covered with a heat-resistant polyamide-imide or the like. Namely, the end coil 82 ensures the actual cross section larger than the center coil 81 by increasing the number of wires by using copper wires with the diameter smaller than that of the center coil 81.

The operating frequency of the center coil 81 is 22–35 kHz. The operating frequency of the end coil 82 is 57–75 kHz. The operating frequency of the end coil 82 is higher than the operating frequency of the center coil 81. When the operating frequency of the current flowing in the coil wires increases, the depth of penetration becomes shallow, and the end coil 82 increases in the copper loss compared with the center coil 81. Thus, the end coil 82 uses a copper wire with the diameter of 0.3 mm smaller than 0.5 mm of the copper wire of the center coil 81, to decrease the copper loss.

It is necessary to decrease the impedance of the end coil 82 to increase the operating frequency of the end coil 82 higher than that of the center coil 81. As the magnetic combination of the end coil 82 against the heating roller 2 that is a load becomes small, and the load resistance (R) of the heating roller 2 is reduced, the current flowing in the end coil 82 is increased. Therefore, if the actual cross section of the end coil 82 is equal to that of the center coil 81, the end coil 82 is increased in the copper loss compared with the center coil 81. Thus, the end coil 82 uses 60 copper wires to decrease the copper loss, that is, to make the actual cross section larger than that of the center 81.

Therefore, the end coil 82 has the shape to provide the output frequency of 75 kHz when the heating roller 2 is at a high temperature (170° C.) and the output power of 300 W is supplied, and the output frequency of 57 kHz when the output power of 700 W is supplied.

The number of turns of the center coils with the lower operating frequency range is more than the end coil with the higher operating frequency range.

The end coil 83 has the configuration similar to the end coil 82.

Figure 9:
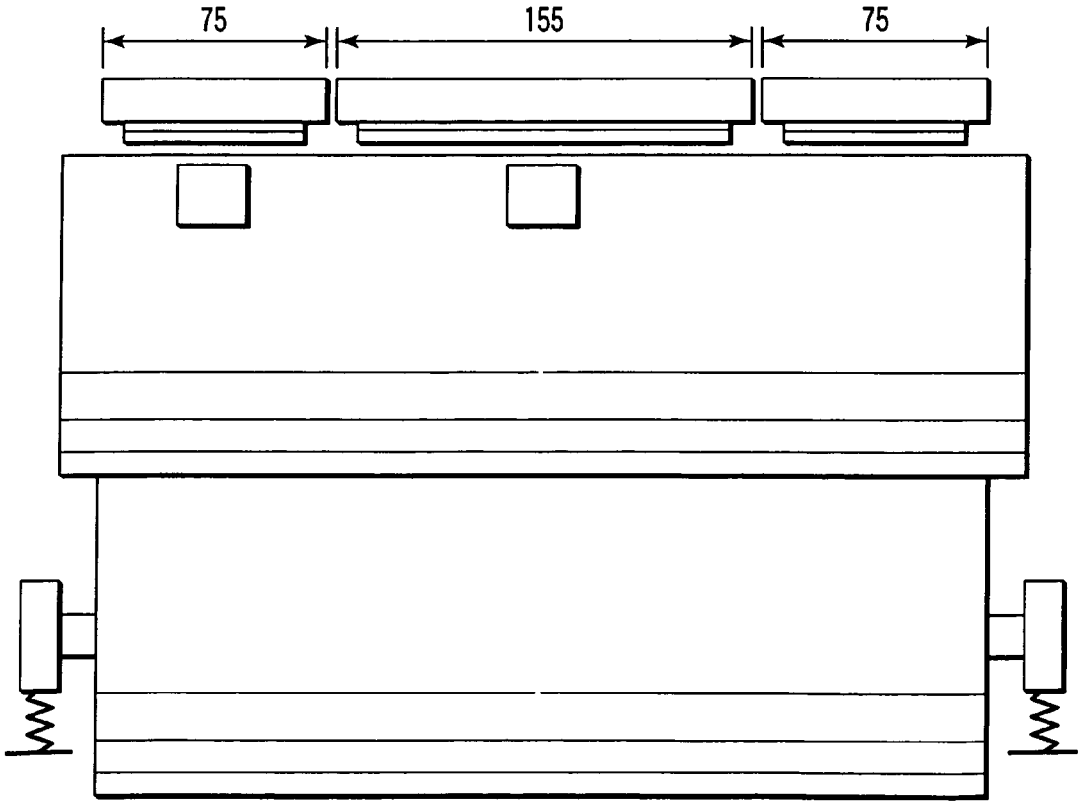
FIG. 9 is a schematic diagram of the fixing apparatus shown in FIG. 1 viewed from the arrow R direction.

As shown in FIG. 9, the center coil 81 has the length of 155 mm in the axial direction of the heating roller 2. The end coils 82 and 83 have the length of 75 mm in the axial direction of the heating roller 2. This is based on the result of the evaluation experiments that the temperature of the heating roller 2 is made most even by making the temperature of the heating roller 2 even by passing the paper sheet P of different sizes between the heating roller 2 and the pressing roller.

Therefore, as shown in FIG. 6, even if the temperatures of the heating roller 2 and coils 81–83 increase, the difference between the highest frequency (35 kHz) of the current flowing in the center coil 81 and the lowest frequency (57 kHz) of the current flowing in the end coils 82 and 83 is higher than an audible frequency range of 20 kHz, and interference noise is not generated.

Using a low price self-excited inverter circuit can reduce the cost.

In this embodiment, the operating frequencies of the end coils 82 and 83 are set higher than that of the center coil 81. This prevents the following problems that may occur when different power is supplied to the center coil 81 and end coils 82/83.

For example, when A3 paper sheet P is passed, the heat amount of the whole heating roller 2 is taken by the paper sheet P, and the power supplied to the center coil 81 and end coils 82/83 becomes a similar value. Therefore, the difference between the operating frequency of the center coil 81 and the operating frequencies of the end coils 82 and 83 is kept in a similar range.

In Contrast, when a small-size paper sheet P is passed, the paper sheet P passes only at the center portion of the heating roller 2, only the heat at the center of the heating roller 2 is taken by the paper sheet P, and the power supplied to the center coil 81 becomes larger than the power supplied to the end coils 82 and 83. Therefore, the operating frequency of the center coil 81 becomes smaller, and the operating frequencies of the end coils 82 and 83 become larger. Namely, the difference between the operating frequency of the center coil 81 and the operating frequencies of the end coils 82 and 83 is increased.

It will not occur that only the heat at the end of the heating roller is taken and the power supplied to the end coils 82 and 83 is increased higher than the power supplied to the center coil 81.

Therefore, by setting the operating frequencies of the end coils 82 and 83 higher than that of the center coil 81, a larger margin is ensured for the difference between the operating frequency of the center coil 81 and the operating frequencies of the end coils 82 and 82.

However, if the operating frequencies of the end coils 82 and 83 are set lower than that of the center coil 81, when a small-size paper sheet P is passed, and the power supplied to the center coil 81 is made larger than the power supplied to the end coils 82 and 83, the difference between the operating frequency of the center coil 81 and the operating frequencies of the end coils 82 and 83 is reduced to close to an audible frequency range of 20 kHz. Thus, the margin for the difference between the operating frequency of the center coil 81 and the operating frequencies of the end coils 82 and 83 becomes small.

Therefore, as in this embodiment, by setting the operating frequencies of the end coils 82 and 83 larger than that of the center coil 81, a larger margin is ensured, it is prevented that the difference between the operating frequency of the center coil 81 and the operating frequencies of the end coils is reduced to close to an audible frequency range, and interference noise is prevented.

Next, description will be given on examples of adjusting the inductance of the coils 81–83 and increasing the difference between the operating frequency of the center coil 81 and the operating frequency of the end coils 82 and 83 with reference to FIGS. 10A, 10B, 11A and 11B.

Figure 10A:
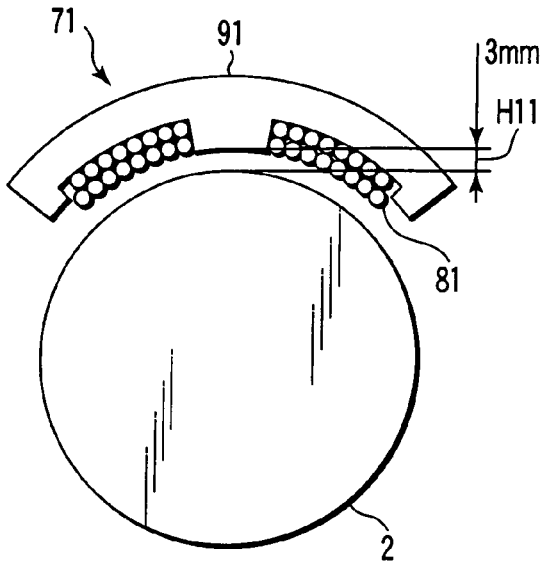
FIGS. 10A and 10B show cross sections of a coil body and a heating roller applicable to the fixing apparatus shown in FIG. 1.
Figure 10B:
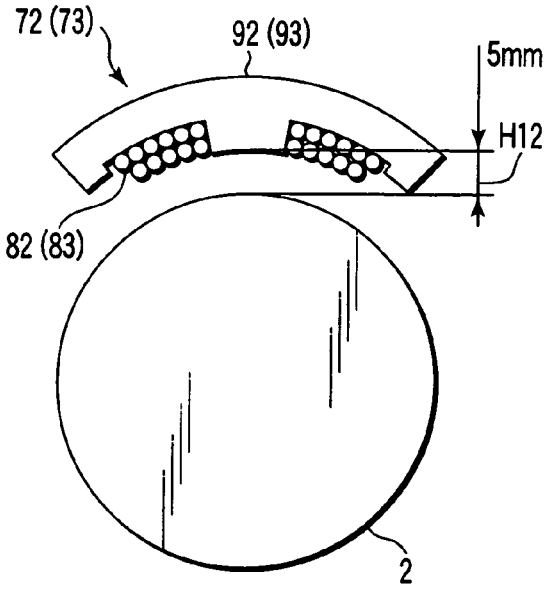

In the example shown in FIGS. 10A and 10B, the distance H11 between the center coil 82 and the surface of the heating roller 2 is set smaller than the distance H12 between the end coils 82, 83 and the surface of the heating roller 2, the inductance of the center coil 81 is made larger than that of the end coils 82 and 83, and the operating frequency of the center coil 81 is decreased. Therefore, the difference between the operating frequency of the center coil 81 and the operating frequencies of the end coils 82 and 83 is increased, and interference noise is prevented.

In this embodiment, the distance H11 is 3 mm, and the distance L12 is 5 mm.

Figure 11A:
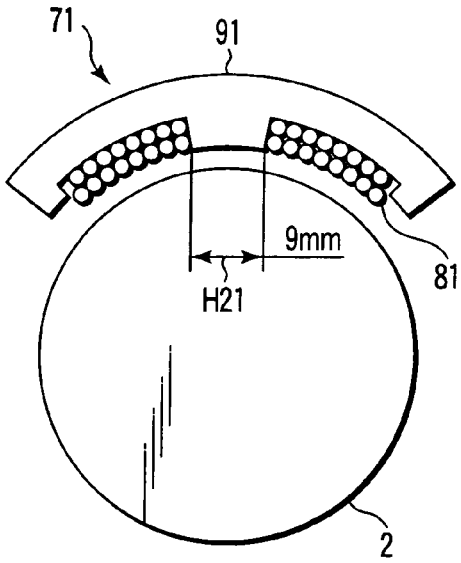
FIGS. 11A and 11B show cross sections of a coil body and a heating roller applicable to the fixing apparatus shown in FIG. 1.
Figure 11B:
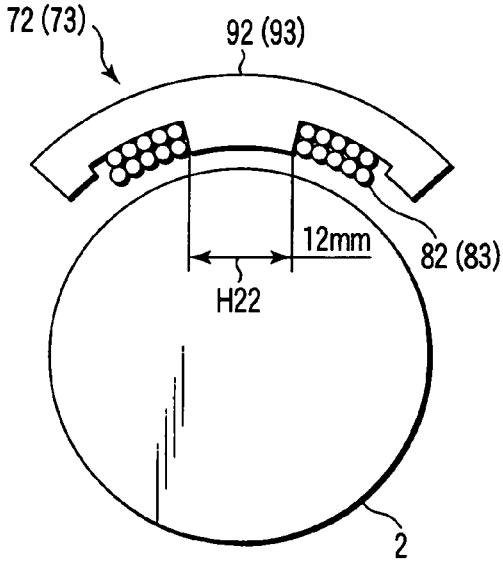

In the example shown in FIGS. 11A and 11B, the length H21 of the magnetic material core 91 provided on the winding axis of the center coil 81 in the direction orthogonal to the axial direction of the heating roller 2 on the surface opposite to the heating roller is set longer than the length H22 of the magnetic material core 92 provided on the winding axis of the end coil 82 in the direction orthogonal to the axial direction of the heating roller 2 on the surface opposite to the heating roller, the inductance of the center coil 81 is increased, and the operating frequency of the center coil 81 is decreased.

The end coil 83 has the configuration similar to the end coil 82. Thus, the difference between the operating frequency of the center coil 81 and the operating frequencies of the end coils 82 and 83 is increased, and an interference noise is prevented.

Further, it is also possible to make a difference between the operating frequency of the center coil 81 and the operating frequencies of the end coils 82 and 83 by making the OFF time of the first inverter circuit shown in FIG. 3 different from the OFF time of the second inverter circuit.

Concretely, as explained above with reference to FIG. 6, the frequency F of the current flowing in the first and second resonance circuits (coils 81–83) is expressed by:

$$F\ (\mathrm{Hz}) = \frac{1}{2\pi\sqrt{LC}}$$

Thus, the OFF time can be made different by making a difference between the capacitance of the resonance condenser 21 included in the first inverter circuit and the capacitance of the resonance condenser 22 included in the second inverter circuit.

In this embodiment, the resonance condenser 21 is 0.75 μF, and the resonance condenser 22 is 0.3 μF. Therefore, the difference between the operating frequency of the center coil 81 and the operating frequency of the end coils 82 and 83 is increased, and interference noise is prevented.

(Embodiment 2)

Figure 12A:
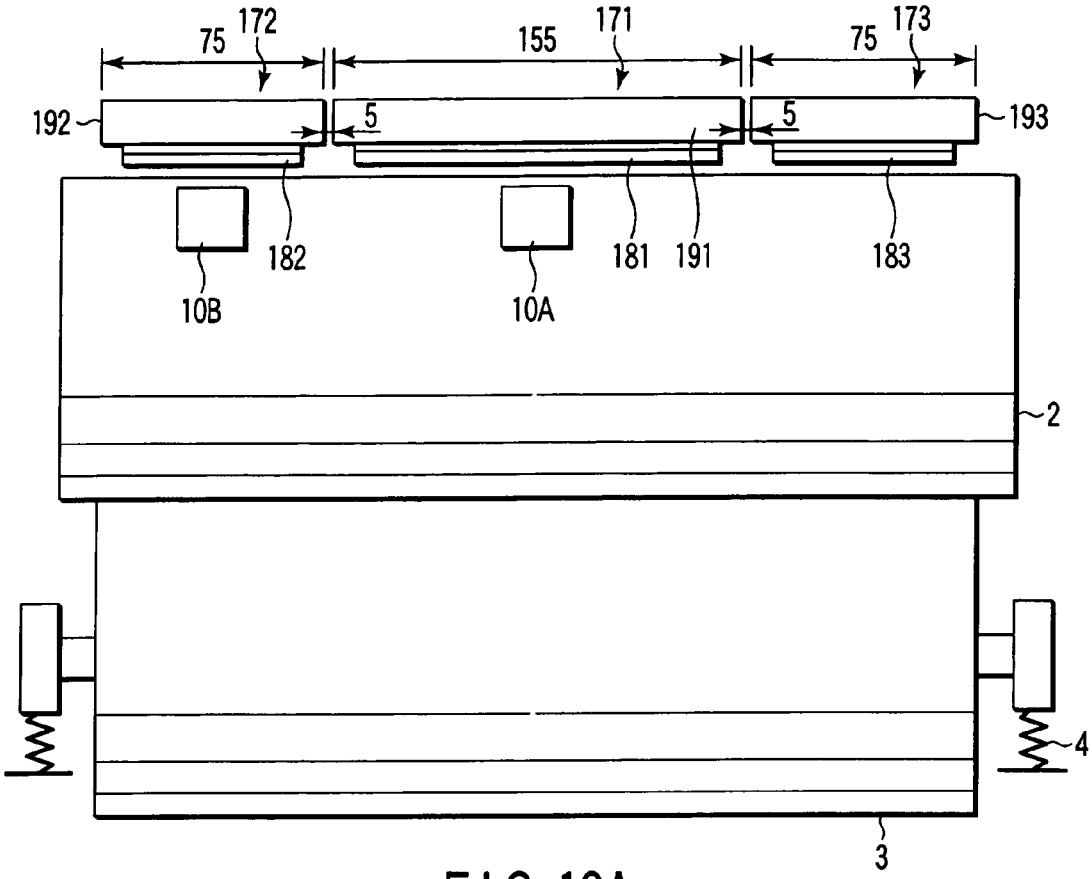
FIGS. 12A, 12B and 12C show schematic views explaining an example of a fixing apparatus according to a second embodiment of the present invention.
Figure 12B:
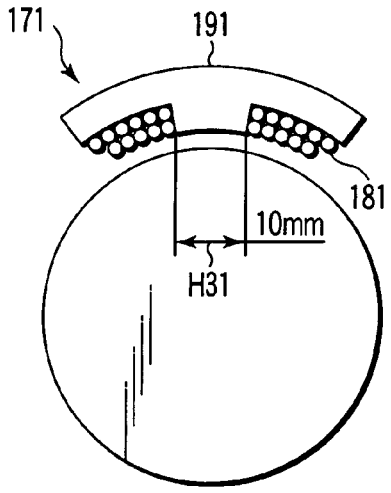
Figure 12C:
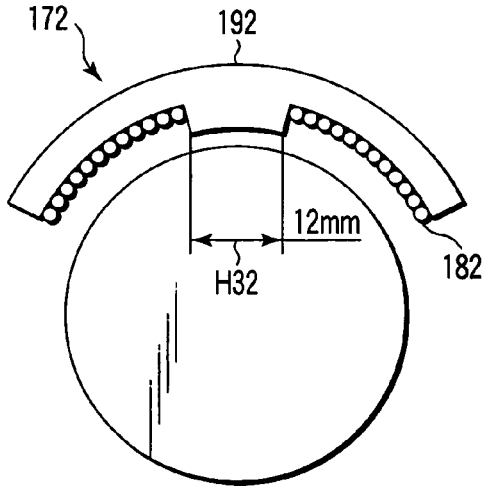

FIGS. 12A–12C shows an example of an induction heater according to this embodiment.

As shown in FIG. 12A, the induction heater of this embodiment includes a coil body 171 which is provided opposite to the center portion in the axial direction of the heating roller 2, and supplies a magnetic field to the center portion of the heating roller 2, and coil bodies 172 and 173 which are provided opposite to the end portions in the axial direction of the heating roller 2, and supplies a magnetic field to the end portions of the heating roller 2. The coil body 171 includes a center coil 181 and a magnetic material core 191. The coil body 172 includes an end coil 182 and a magnetic material core 192. The coil body 173 includes an end coil 183 and a magnetic material core 193. The end coils 182 and 183 are electrically connected in series, forming one end coil 1823.

The coil body 171 has the length of 155 mm in the axial direction of the heating roller 2. The coil bodies 172 and 173 have the length of 75 mm in the axial direction of the heating roller 2. The interval between the coil bodies 171, 172 and 173 is 5 mm to prevent a temperature decrease between the coil bodies of the heating roller 2. Therefore, the maximum length from the end of the coil body 172 to the end of the coil body 173 is 315 mm.

The coils 181–183 are formed so that the inductance L81 of the center coil 181, the inductance L82 of the end 182 and the inductance L83 of the end coil 183 become substantially the same. The coils 181–183 are also formed so that the load resistor R81 of the center coil 181, the load resistor R82 of the end coil 182 and the load resistor R83 of the end coil 183 become substantially the same.

In this embodiment, the number of turns of the center coil 181 is 11, and the numbers of the turns of the end coils 182 and 183 are 12. The areas of the end coils 182 and 183 facing the surface of the heating roller 2 are larger than the area of the center coil 181 facing the surface of the heating roller 2. Thus, the load resistors R82 and R83 of the end coils 182 and 183 become smaller than the load resistor R81 of the center coil 181. For example, a copper wire is wound in two rows in the center coil 181, while one row in the end coils 182 and 183.

Further, in this embodiment, the length H31 of the magnetic material core 191 provided on the winding axis of the center coil 171 in the direction orthogonal to the axial direction of the heating roller 2 on the surface opposite to the heating roller is set shorter than the length H32 of the magnetic material core 192 provided on the winding axis of the center coil 172 in the direction orthogonal to the axial direction of the heating roller 2 on the surface opposite to the heating roller. Concretely, the distance H31 is 10 mm, and the distance H32 is 12 mm. Thus, the combination of the magnetic flux of the end coils 182 and 183 becomes strong, and the magnetic characteristics become equivalent to those of the center coil 181.

If the magnetic characteristics of the coils 181–183 do not become equivalent even by the above method, make a difference in the distance between the center coil 181 and the heating roller 2 different and the distance between the heating roller 2 and the end coils 182 and 183, as explained with reference to FIGS. 11A and 11B. Or, make the composition of the litz wire included in the center coil 181 different from the composition of the litz wire included in the end coils 182 and 183, as in the first embodiment. Or, make the shape of the magnetic core 191 different from the shapes of the magnetic cores 192 and 193. By adjusting the inductance of the center coil 181 and end coils 182 and 183 as described above, the magnetic characteristics of the center coil 181 and end coils 182 and 183 can be made equal.

The coils 181–183 are supplied with the same output power, and the temperature of the heating roller 2 is adjusted by using the ON/OFF control explained hereinbefore.

Thus, the operating frequencies of the coils 181–183 become substantially the same with a difference of about 150 Hz. Therefore, the fixing apparatus according to this embodiment can be housed in a copier, and interference noise is not disturbing.

With the above configuration, a low price self-excited inverter circuit can be used, and the cost can be reduced.

(Embodiment 3)

Figure 13:
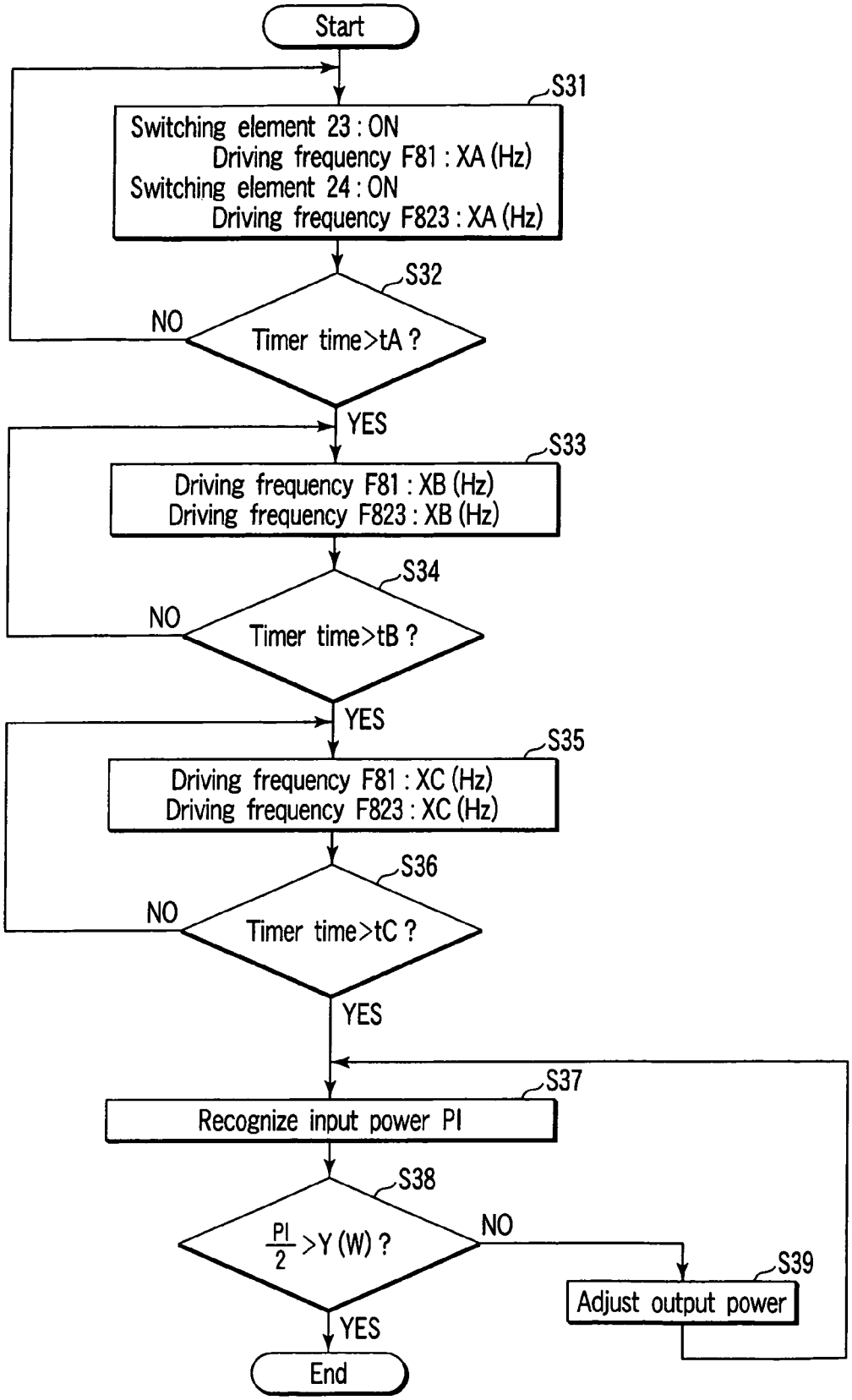
FIG. 13 is a flowchart explaining an example of a control method applicable to the fixing apparatus of the present invention.

FIG. 13 is a flowchart explaining an example of a control method applicable to the fixing apparatus of the present invention.

As explained with reference to FIG. 3, the heating roller 2 of this embodiment is heated by the predetermined magnetic field supplied from a first inverter circuit including the center coil 81, and a second inverter circuit including the end coils 82 and 83. The center coil 81 and the end coil 823 comprising the end coils 82 and 83 are independently controlled by the control circuits 29 and 30. The switching elements 23 and 24 are operated in four patterns; turned on simultaneously, one turned on while the other turned off, and both turned off. Such a control for adjusting the magnetic field generated from the coils by turning on/off the switching elements, making the surface temperature of the roller 2 even, and keeping at a given temperature, is called an ON/OFF control as described hereinbefore.

When the switching elements 23 and 24 are turned on after once turned off, the coils 81–83 are supplied with power with the gradually increasing operating frequency by soft start control. The soft start control mentioned here means a feedback control by the CPU 28, that is, power smaller than an object output power is supplied first so that the power supplied to the coils 81–83 is gradually increased to close to the object output power, to prevent supply of the power higher than an object output power to the coils 81–83. Particularly, when the power supply of an apparatus provided with the fixing apparatus 1 is turned on, that is, at warming up, it is difficult to detect exactly the temperature of the heating roller 2. Thus, at the warming up of this embodiment, the power supplied to the coils 81–83 is not controlled based on the feedback detection temperature, but the heating roller 2 is heated to a given fixing temperature by the soft start control.

For example, if the driving frequency for supplying an object output power to the coils 81–83 is 30 kHz, the soft start control is executed so that the power corresponding to the driving frequency 40 kHz is supplied first, and then the power with minutely different driving frequencies 35 kHz to 32 kHz, for example, is supplied gradually until power corresponding to 30 kHz is supplied.

This prevents supply of the output power exceeding an object output power value to the coils 81–83, and also prevents an unnecessary rush current, solving a so-called flicker problem such as flickering of a fluorescent lamp used nearby.

The ON/OFF control and soft start control are applied to both the center coil 81 and end coils 82 and 83 (823). Thus, when the center coil 81 is turned off and turned on again later by the soft start control, if the end coil 823 is always turned on with a given driving frequency, a driving frequency difference is generated between the center coil 81 and end coil 823. When this difference is over 200 Hz or audible frequency range, generated interference noise is at the level sensed by a human being. For reference, the audible frequency range is generally 20 Hz-20 kHz.

When the power supplied to the center coil 81 reaches the object output power, the driving frequency difference between the center coil and end coil 823 is decreased to within 200 Hz, and interference noise is not disturbing. But, at present, in the soft start control, about 0.5 seconds is required to reach the object output power. The switching elements 23 and 24 are turned off each time the temperature detected by the thermistors 10A and 10B reaches the control temperature from the CPU. Whenever the switching elements 23 and 24 are turned off, the problem of 0.5 second interference noise occurs.

Now description will be given on an example of a method of supplying power to the center coil 81 and end coil 823 by using the ON/OFF control and soft start control with reference to FIGS. 13 and 14.

FIG. 13 is a flowchart explaining an example of a control method of turning on the turned-off center coil 81 and end coil 823 at a time. This control method can be used when the power supply of an apparatus provided with the fixing apparatus 1 is turned on, or when recovering the temperatures of the center coil 81 and end coil 823 from the off state.

As shown in FIG. 13, for supplying the object output power Y (W) to the center coil 81 and end coil 823, the CPU 28 executes the soft start control to instruct minutely different driving frequencies such as frequencies XA, XB and XC (Hz), and heats the surface of the heating roller 2 up to a predetermined temperature. The frequencies XA, XB and XC are in the relation of XA>XB>XC.

The CPU 28 informs the control circuits 29 and 30 of the same frequency XA (Hz) as a driving frequencies F81 instructed to the control circuit 29 and F823 to be instructed to the control circuit 30, turns on the switching elements 23 and 24 at the same time, and supplies power to the center coil 81 and end coil 823 (S31).

When the predetermined time tA to instruct the driving frequency XA elapses (S32—YES), the CPU 28 informs the control circuits 29 and 30 of the frequency XB smaller than XA as the driving frequencies F81 and F82. The switching elements 23 and 24 are turned on based on the ON time corresponding to the driving frequency XB (S33).

When the predetermined time tB to instruct the driving frequency XB elapses (S34—YES), the CPU 28 informs the control circuits 29 and 30 of the frequency XC smaller than XB as the driving frequencies F81 and F82. The switching elements 23 and 24 are turned on based on the ON time corresponding to the driving frequency XC (S35).

Further, when the predetermined time tC to instruct the driving frequency XC elapses (S36—YES), the CPU 28 detects the input power PI output from the input power monitor 27 (S37).

In this embodiment, the same power is supplied to the center coil 81 and end coil 823. Thus, the value of ½ of the input power PI is the output power supplied to the center coil 81 and end coil 823. Therefore, the CPU 28 determines whether the ½ of the input power PI reaches the object output power YD (W) (S38). If not (S38—NO), the CPU 28 makes fine adjustment of the driving frequencies F81 and F823 so that the double of the power monitored by the CPU 28 comes close to the value of the input power monitor 27 (S39).

When the ½ of the input power PI reaches the object output power Y (W) (S38—YES), the soft start control is finished. At this time, the switching elements 23 and 24 are both in the ON state, and power is supplied to both the center coil 81 and end coil 823.

The heating roller 2 is heated to a given temperature as described above. The difference between the driving frequencies F81 and F823 is within 200 Hz, and interference noise is not disturbing.

The time tA-tC is stored in the ROM 28*b*. The CPU 28 refers to the time tA-tC stored in the ROM 28*b*, and compares them with the time measured by the timer 28*a*.

Next, description will be given on the control to keep the temperature of the heating roller 2 heated to a given temperature even in the axial direction.

Figure 14:
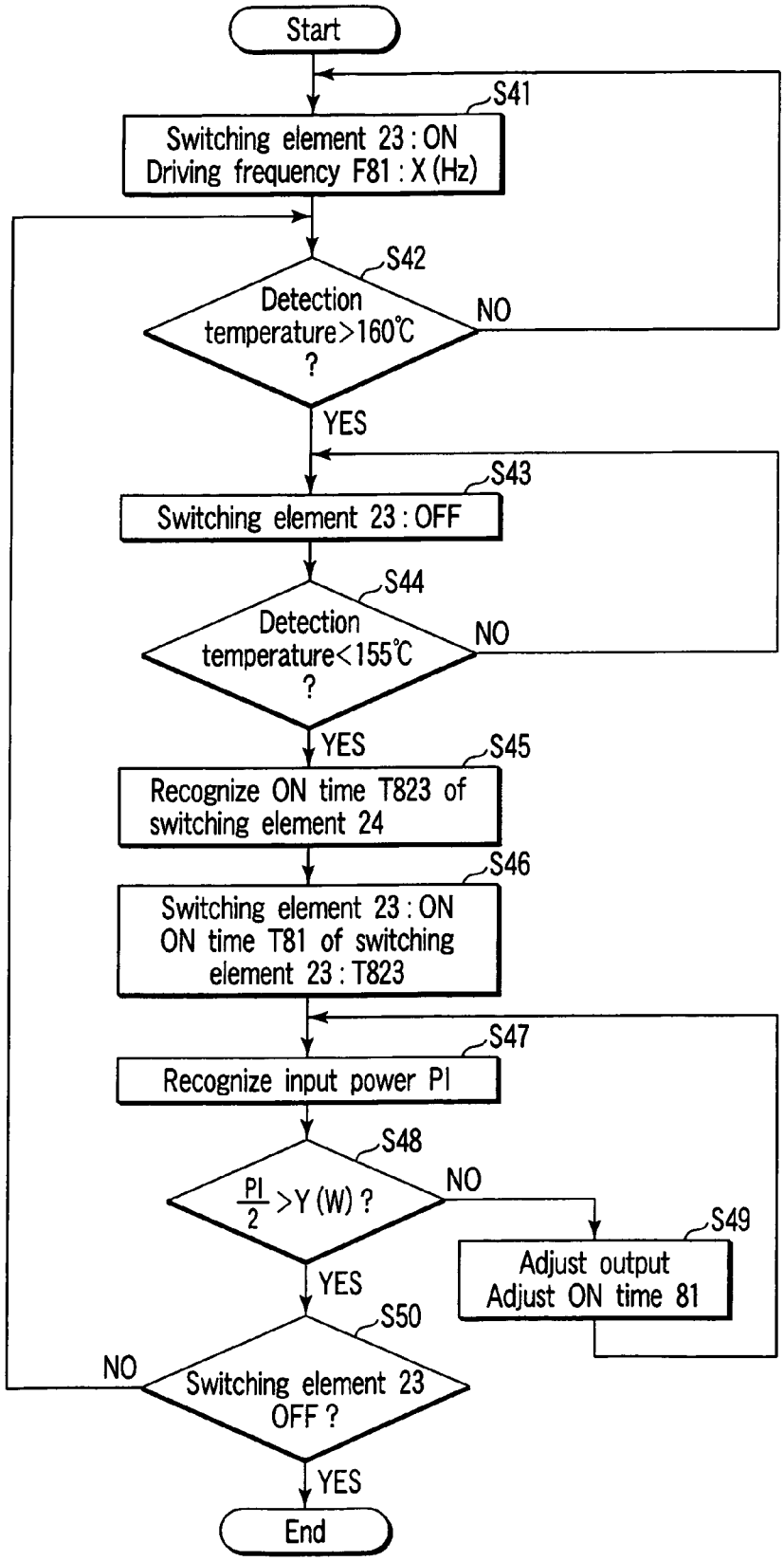
FIG. 14 is a flowchart explaining another example of a control method applicable to the fixing apparatus of the present invention.

FIG. 14 is a flowchart explaining the ON/OFF control to make the temperature of the heating roller 2 even in the axial direction, and the restore control to turn on the switching elements after once turned off by the ON/OFF control. FIG. 14 is a flowchart explaining the case that the end coil 823 is usually on and the center coil 81 is turned off.

As shown in FIG. 14, the CPU 28 informs the control circuit 29 of the frequency X (Hz) as the driving frequency F81 to supply a current of the frequency X (Hz) to the center coil 81 in order to make the surface temperature of the heating roller 2 even, for example, 160° C. in the axial direction. The control circuit 29 turns on the switching element 23 through the driving circuit 31 based on the ON time T81 corresponding to the driving frequency F81 (S41).

The CPU 28 determines whether the temperature detected by the thermistor 10A reaches the control temperature (160° C.) (S42). If not, the CPU returns to step S41 and turns on the switching element 23 until the detection temperature reaches the control temperature (S42—NO). If the detection temperature reaches the control temperature (S42—YES), the switching element 23 is turned off (S43).

The CPU 28 recognizes the ON time T823 of the switching element 24 in the step (S44—YES) that the thermistor 10A detects 155° C., for example, 5° C. lower than the control temperature, in order to turn on the switching element 23 not to excessively decrease the temperature of the heating roller 2 (S45).

The CPU 28 controls the control circuit 29 to turn on the switching element 23 at the same ON time as the ON time T823 of the switching element 24. In other words, the CPU 28 informs the control circuit 29 of the same driving frequency F81 as the driving frequency F823 instructed to the control circuit 30 (S46).

As above described, in this embodiment, the same power is supplied to the center coil 81 and end coil 823. Thus, the value of ½ of the input power PI is the output power supplied to the center coil 81 and end coil 823. Therefore, the CPU 28 determines whether the ½ of the input power PI reaches the object output power Y (W) (S48). If not (S48—NO), the CPU 28 makes fine adjustment of the driving frequency F81 so that the double of the power monitored by the CPU 28 becomes close to the value of the input power monitor 27 (S49).

When the ½ of the input power PI reaches the object output power Y (W) (S48—YES), if the switching element 23 is turned off by the turning off of the power supply of the apparatus (S50—YES), the recovery control is finished.

If an instruction to turn off the switching element 23 is not issued (S50—NO), the operation is returned to step S42. Therefore, the heating roller is heated to keep it at a given temperature.

As described above, the difference between the driving frequencies F81 and F823 is within 200 Hz, and interference noise is not disturbing.

The same control is applicable to the case that the center coil is usually on and the end coil 823 is turned off.

The above embodiments 1–3 have been explained by using a fixing apparatus of the type that a paper sheet P passes through the center of the heating roller 2 as shown in FIG. 2. The invention is not limited to this type. It is possible to use a fixing apparatus of the type shown in FIG. 15.

Figure 15:
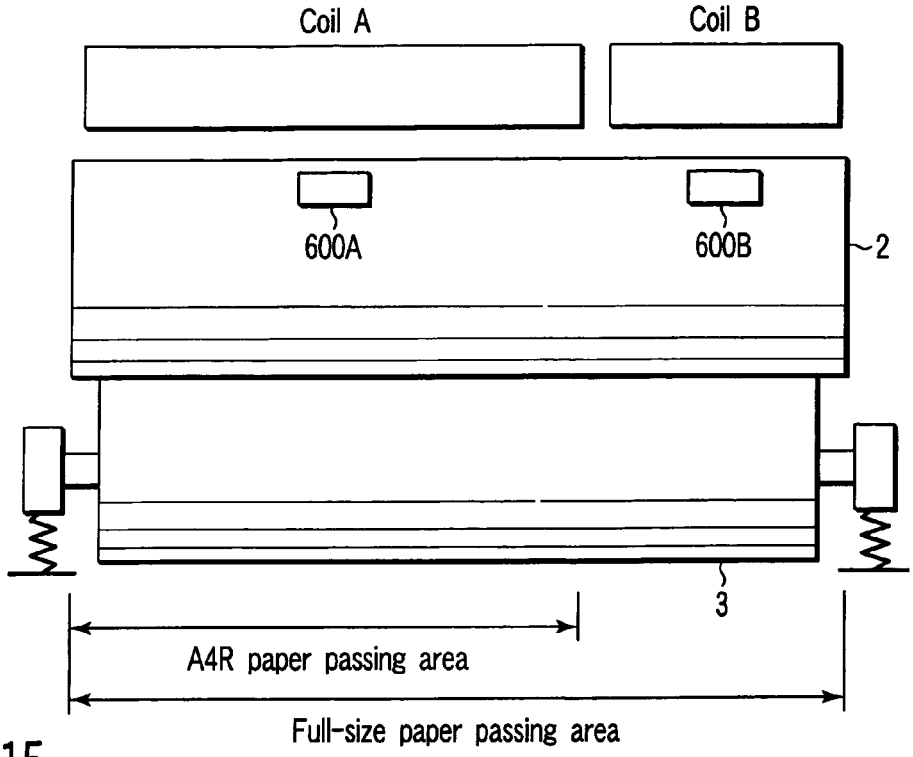
FIG. 15 is a schematic diagram showing another example of a fixing apparatus applicable to the present invention.

The fixing apparatus shown in FIG. 15 is of the type in which the end of paper sheet P passes along the end of the heating roller 2. Explaining in details, it includes a coil A which heats the area to pass a small A4R paper sheet P, and a coil B which heats the area to pass a full size paper sheet P, that is, the area adjacent to the area heated by the coil A. If the coil A and coil B are substituted for the center coil 81 and end coil 823, respectively, the control system shown in FIG. 3 is applicable. Therefore, the thermistor 10A shown in FIG. 3 detects the temperature of the area heated by the coil A, and thermistor 10B detects the temperature of the area heated by the coil B.

(Embodiment 4)

Figure 16:
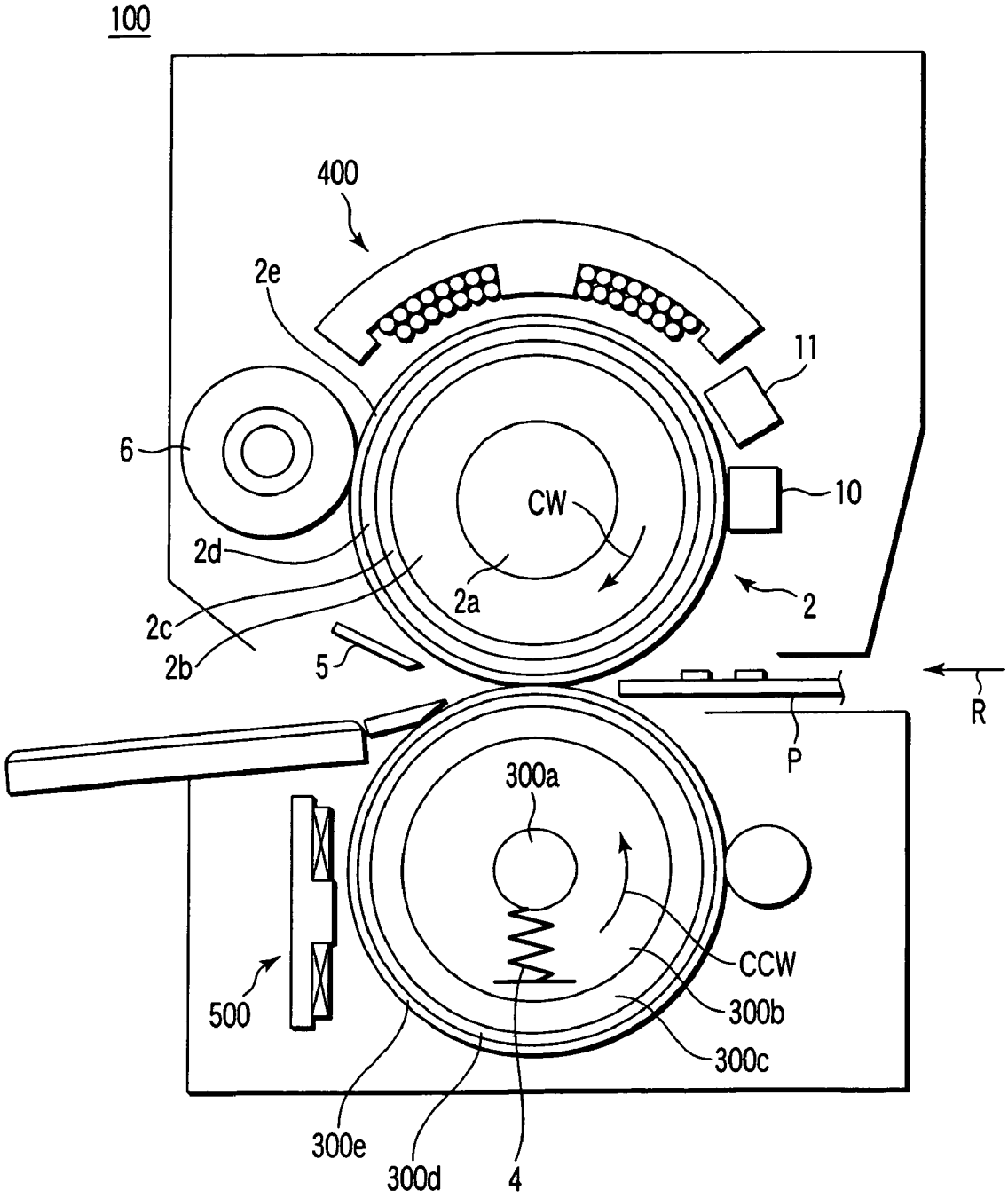
FIG. 16 is a schematic diagram explaining an example of a fixing apparatus according to a fourth embodiment of the present invention.
Figure 17:
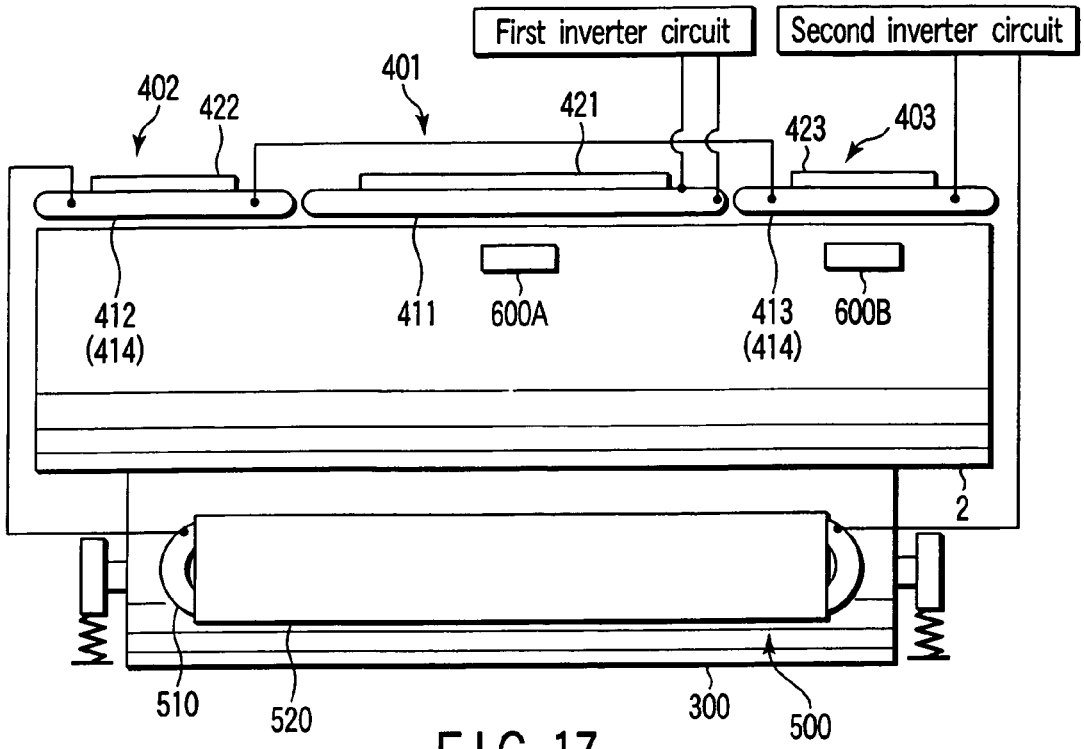
FIG. 17 is a schematic diagram of the fixing apparatus shown in FIG. 16 connected in a first pattern, viewed from the arrow R direction.
Figure 18:
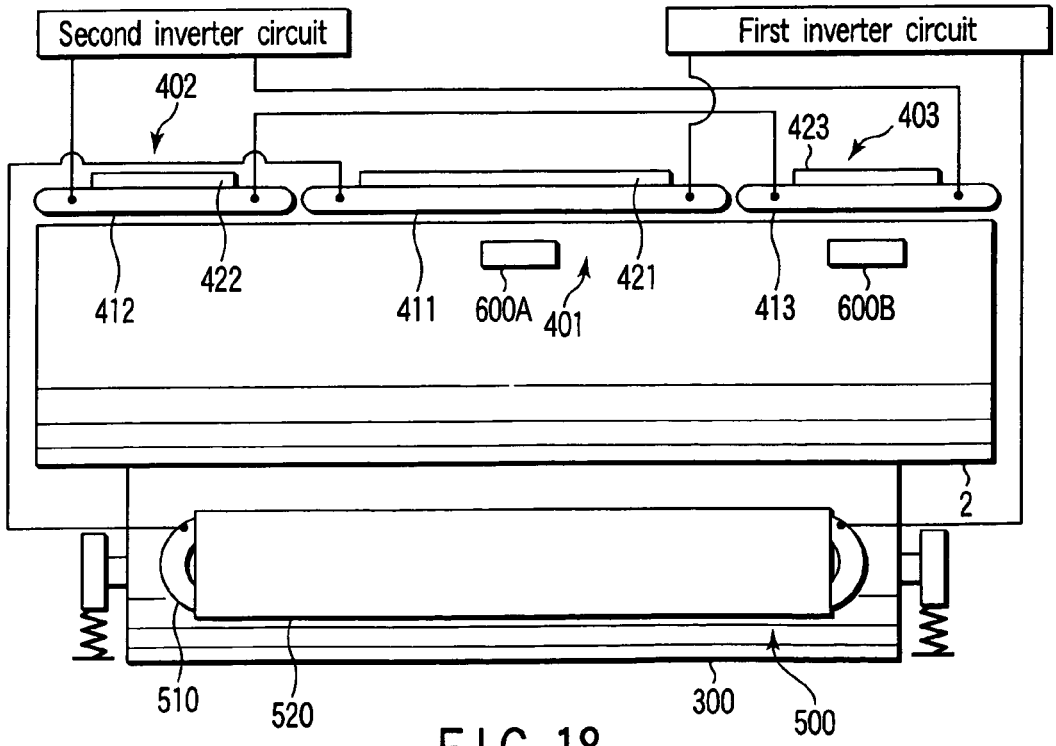
FIG. 18 is a schematic diagram of the fixing apparatus shown in FIG. 16 connected in a second pattern, viewed from the arrow R direction.

FIG. 16 shows an example of a fixing apparatus according to this embodiment. FIG. 17 and FIG. 18 shows the schematic diagram of the fixing apparatus shown in FIG. 16 viewed partially from the arrow R direction.

As shown in FIG. 16, a fixing apparatus 100 of this embodiment has a heating member (a heating roller) 2, a pressing member (a pressing roller) 300, a pressing spring 4, a peel-off claw 5, a cleaning roller 6, a first induction heater 400, a second induction heater 500, a temperature detection mechanism 10, and a thermostat 11.

The heating roller 2 has a shaft 2*a*, elastic layers 2*b*, a metal member (a conductive metal layer) 2*c*, a solid rubber layer 2*d*, and a mold releasing layer 2*e*, as described in the embodiment 1.

The pressing roller 300 has the configuration similar to the heating roller 2. The pressing roller 300 has a shaft 300*a* made of material with the rigidity (hardness) not deformed by a given pressure, elastic layers (a foam rubber layer, a sponge layer and a silicone rubber layer) 300*b* provided sequentially around the shaft 300*a*, a metal member (a conductive metal layer) 300*c*, a solid rubber layer 300*d* and a mold releasing layer 300*e*. The solid rubber layer 300*d* and mold releasing layer 300*e* are mode of a thin film such as a heat-resistant silicone rubber.

The foam rubber layer 300*b* is harder than the foam rubber layer 2*b* included in the heating roller 2. In other words, the foam rubber layer 300*b* has the higher rubber hardness than the foam rubber layer 2*b*. Thus, the surface of the foam rubber layer 2*b* is slightly concaved in the nip contacting the foam rubber layer 300*b*. Therefore, the paper sheet P passing through the nip is easy to separate from the heating roller 2.

The conductive metal layer 300*c* is made of conductive material (e.g., nickel, stainless steel, aluminum, copper, and aluminum-stainless steel compound material). In this embodiment, the conductive metal layer 300*c* is made of nickel.

In this embodiment, the foam rubber layer 300*b* is 5 mm thick, the conductive metal layer 300*c* is 40 μm thick, the solid rubber layer 300*d* is 200 μm thick, and the mold releasing layer 300*e* is 30 μm thick, respectively. The heating roller 300 has the diameter of 40 mm. The heating roller 2 is not limited to the configuration of this embodiment, and may be configured to have a core metal made of magnetic material and a mold releasing layer provided outside the metal core.

The heating roller 2 is rotated by a motor in the arrow CW direction at a substantially constant speed. The pressing roller 300 is pressed to the heating roller 2 by a given pressure of the pressing spring 4, and rotated in the direction (in the arrow CCW direction) reverse to the heating roller 2 at the position contacting the heating roller 2.

The first induction heater 400 is provided outside the heating roller 2, and the second induction heater 500 is provided outside the pressing roller 300.

Next, the first and second induction heaters 400 and 500 will be explained in detail with reference to FIGS. 17 and 18.

As shown in FIGS. 17 and 18, the first induction heater 400 includes a coil body 401 which is placed opposite to the center portion in the axial direction of the heating roller 2 and supplies a magnetic field to the center portion of the heating roller 2, and coil bodies 402 and 403 which are placed opposite to the end portion in the axial direction of the heating roller 2 and supply a magnetic field to the end portion of the heating roller 2. The coil body 401 includes a center coil 411 and a magnetic material core 421. The coil body 402 includes end coil 412 and a magnetic material core 422. The coil body 403 includes an end coil 413 and a magnetic material core 423. The end coils 412 and 413 are electrically connected in series, forming one end coil 823.

The second induction heater 500 includes a coil 510 which is placed totally opposite to the axial direction of the heating roller 300 and supplies a magnetic field to the surface of the pressing roller 300, and a magnetic material core 520.

In the outside of the heating roller 2, there are provided a thermistor 600A which detects the temperature of the outer circumference area of the heating roller 2 heated by the coil body 411, and a thermistor 600B which detects the temperature of the outer circumference area of the heating roller 2 heated by the coil body 413. In this embodiment, a thermistor that detects the temperature of the pressing roller 300 is not provided in the outside of the pressing roller 300. However, by using the thermostat 11 shown in FIG. 3, an abnormal temperature increase in the surface of the pressing roller 300 is prevented.

The coil 510 of second induction heater 500 uses one of the center coil 411 and end coil 414 of the first induction heater 400, and an inverter circuit.

FIG. 17 is a schematic diagram of the fixing apparatus having the first and second induction heaters 400 and 500 connected in a first pattern.

In the first pattern, the end coil 414 and coil 510 are connected in series, and each of them uses one inverter circuit (a second inverter circuit).

Explaining with reference to FIG. 19 referred to in the later explanation, the center coil 411 is connected in parallel with the resonance condenser 21, forming a first resonance circuit. The coils 412, 413 and 510 connected in series are connected in parallel with the resonance condenser 22, forming a second resonance circuit. The first inverter circuit includes the first resonance circuit and the switching element 23 connected in series. The second inverter circuit includes the second resonance circuit and the switching element 24 connected in series.

FIG. 18 is a schematic diagram of the fixing apparatus having the first and second induction heaters 400 and 500 connected in a second pattern.

In the second pattern, the center coil 411 and coil 510 are connected in series, and each of them uses one inverter circuit (a first inverter circuit).

Explaining with reference to FIG. 20 referred to in the later explanation, the coils 411 and 510 connected in series is connected in parallel with the resonance condenser 21, forming a first resonance circuit. The end coils 412 and 413 connected in series are connected in parallel with the resonance condenser 22, forming a second resonance circuit. The first inverter circuit includes the first resonance circuit and the switching element 23 connected in series. The second inverter circuit includes the second resonance circuit and the switching element 24 connected in series.

As described above, in this embodiment, an inverter circuit is not provided for the coil 510, and the inverter circuit common to the center coil 411 or end coil 414 is used. Thus, only two inverter circuits are used, and the cost is reduced.

The coils 411, 412, 413 and 510 have a predetermined ratio of output power according to the number of turns. The coil 510 is formed to be supplied with the power smaller than the power supplied to the coils 411, 412 and 413.

In this embodiment, the end coil 412 has 15 turns, the end coil 413 has 15 turns, and the coil 510 has 8 turns. Therefore, the ratio of output power among them is as follows. The end coil 412 is 40%, the end coil 413 is 40%, and the coil 510 is 20%. In other words, the output power ratio of the end coil 414 to the coil 510 is 4:1.

Concretely, 440 W is supplied to the center coil 411, 440 W is supplied to the end coils 412 and 413, and 110 W is supplied to the coil 510. Therefore, 880 W is supplied to the first induction heater 400 to heat the heating roller 2, and 110 W is supplied to the second induction heater 500 to heat the pressing roller 300. As describe above, compared with the first induction heater 400, the power supplied to the second induction unit 500 is small.

The surface temperature of the pressing roller 300 can be kept constant with the coils 411–413 and 510 formed to supply the output power according to the ratio as in this embodiment. If there is no heater to heat the pressing roller 2, the temperature of the heating roller 2 is taken by the pressing roller 300, and the surface temperature of the heating roller 2 is decreased. The problem of temperature decrease in the heating roller 2 is solved by heating the surface of the heating roller 300 as in this embodiment. Therefore, the temperatures of the heating roller 2 and the pressing roller 300 can be kept at a given fixing temperature. This prevents defective fixing caused by a temperature decrease on passage of paper sheet P.

In this embodiment, a thermistor to detect the temperature of the pressing roller 300 and an inverter circuit for the second induction heater 500 are not provided, and the cost can be reduced.

(Embodiment 5)

Figure 19:
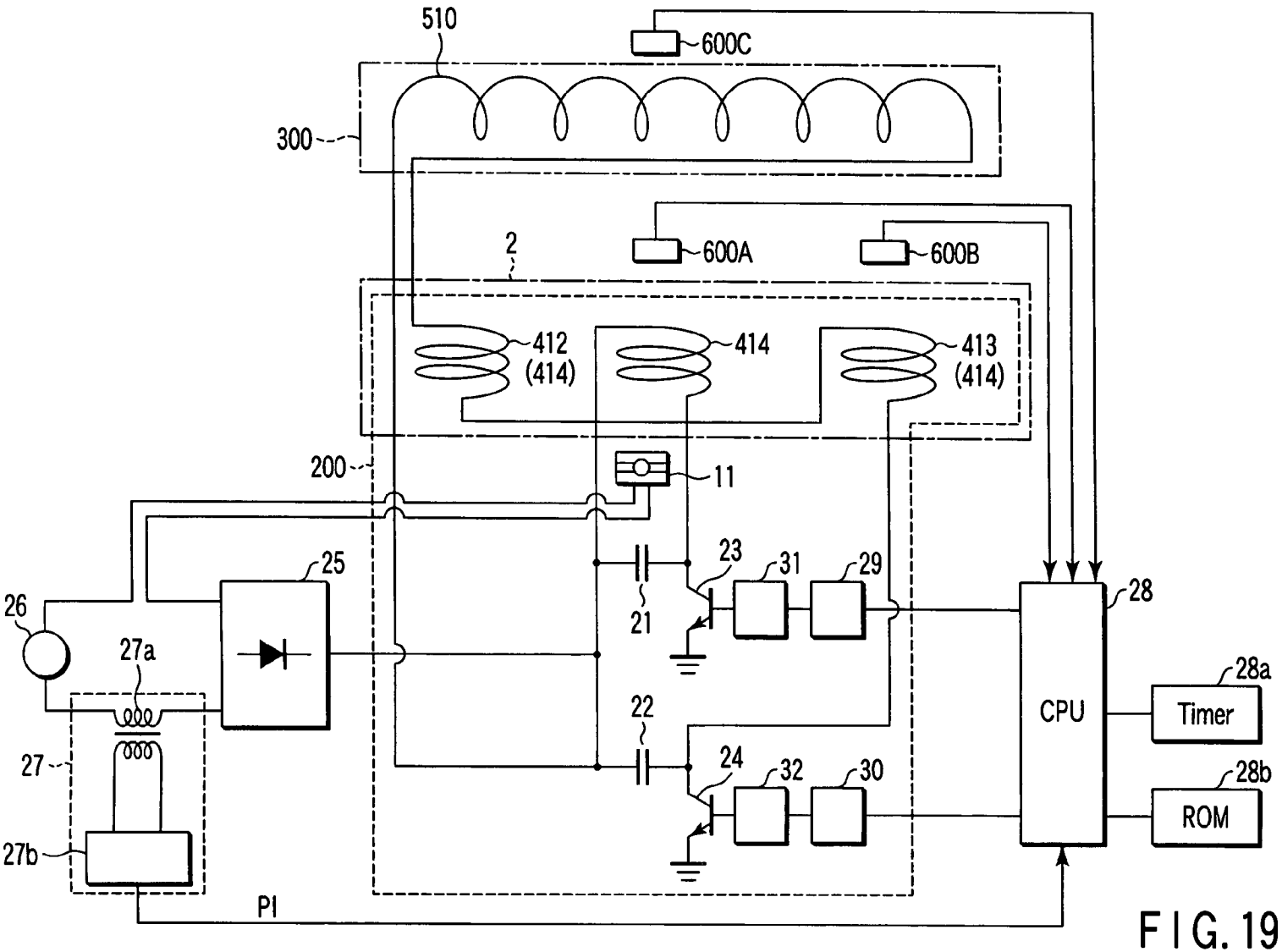
FIG. 19 is a block diagram explaining the control system of the fixing apparatus shown in FIG. 17.
Figure 20:
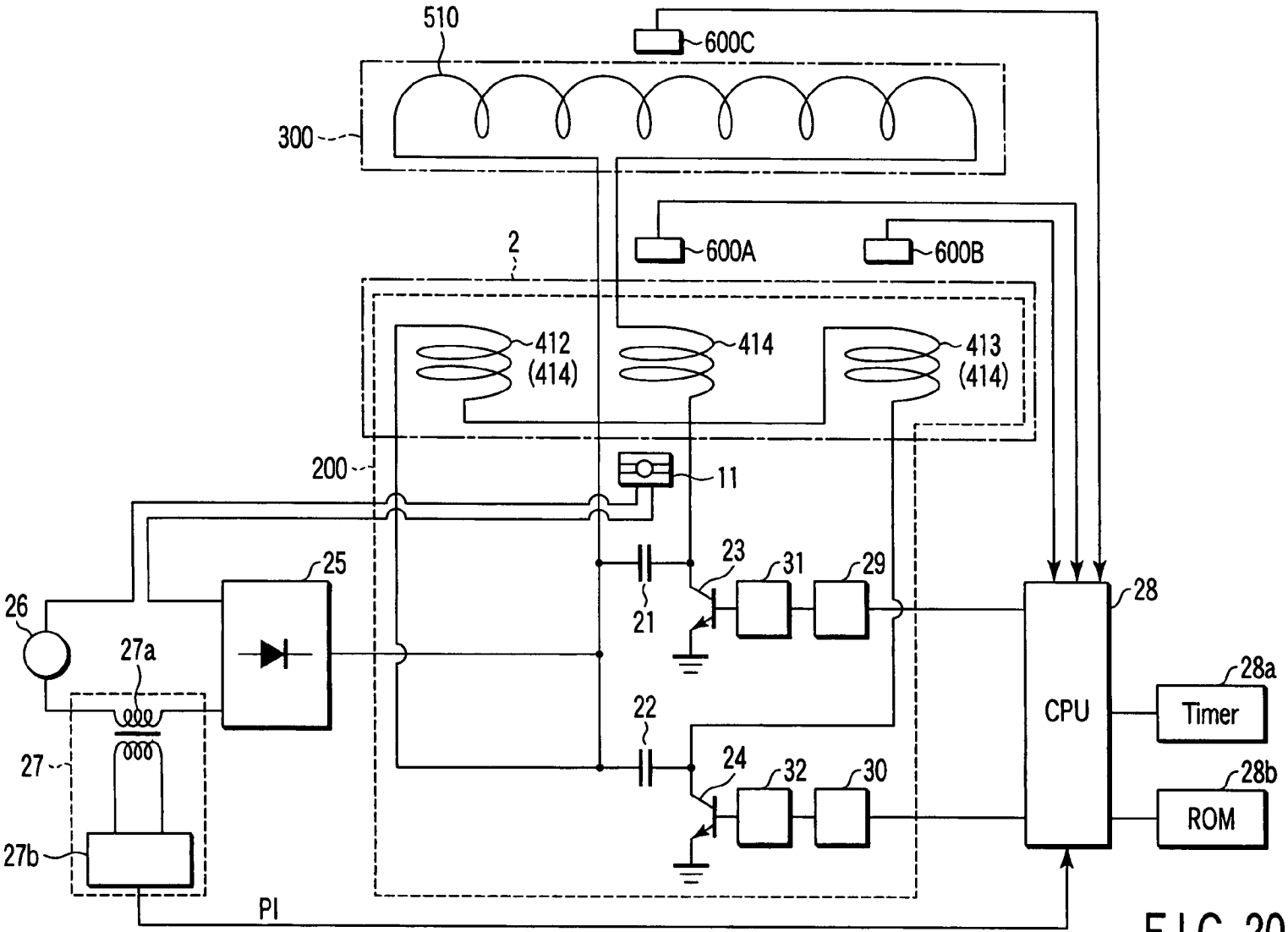
FIG. 20 is a block diagram explaining the control system of the fixing apparatus shown in FIG. 18.

FIGS. 19 and 20 show the block diagram of a fixing apparatus according to this embodiment.

FIG. 19 shows the block diagram of the fixing apparatus shown in FIG. 17 connected in the first pattern explained above. FIG. 20 shows the block diagram of the fixing apparatus shown in FIG. 18 connected in the second pattern explained above. Among the components shown in FIGS. 19 and 20, those shown in FIG. 3 have the same function, and a detailed explanation will be omitted.

The fixing apparatus of this embodiment shown in FIGS. 19 and 20 has a thermistor 600C to detect the temperature of the pressing roller 300, in addition to the fixing apparatus explained in the embodiment 4. The temperature information detected by the thermistor 600C is input to the CPU 28 as a temperature detection signal (a voltage value). In the following description, the temperature detected by the thermistor 600A is called TA, the temperature detected by the thermistor 600B is called TB, and the temperature detected by the thermistor 600C is called TC.

As explained in the embodiment 4, the coils 411, 412, 413 and 510 have the predetermined ratio of output power according to the number of turns. The coil 510 is formed to be supplied with the power smaller than the power supplied to the coils 411, 412 and 413.

In this embodiment, the ratio of output power among the center coil 411, end coil 414 and coil 510 is 5:5:2. Therefore, for example, when the total output power is 1200 W, 500 W is supplied to the center coil 411, 500 W is supplied to the end coils 412 and 413, and 200 W is supplied to the coil 510. When the total output power is 960 W, 400 W is supplied to the center coil 411, 400 W is supplied to the end coils 412 and 413, and 160 W is supplied to the coil 510. These output power are determined according to the signal including the driving frequency information sent from the CPU 28 to the control circuit 29 and 30. In this embodiment, the driving frequency instructed to the driving circuits 31 and 32 through the control circuits 29 and 30 is controlled by the CPU 28 so that the above-mentioned output power is supplied to the coils 411, 414 and 510 at a certain ratio. In other words, when changing the power supplied to the coils 411, 414 and 510, change the output power supplied in total without changing the ratio of the power supplied to each coil. For example, when changing the power supplied to the center coil 411, change also the power supplied to the end coil 414. In contrast, when changing the power supplied to the end coil 414, change also the power supplied to the center coil 411.

Next, description will be given on the operation of the fixing apparatus shown in FIG. 19.

When the power supply of an apparatus provided with the fixing apparatus 1 is turned on, that is, at the warm-up to increase the surface temperature of the heating roller 2 to a given fixing temperature, the ON/OFF control can be used as explained in FIG. 5. In this embodiment, the CPU 28 turns on/off the switching elements (SW) 23 and 24 based on the driving frequency corresponding to the temperature information TA and TB output from the thermistors A and B that is fed back until the thermistors A and B detect 160° C. as a temperature at which the surface temperature of the heating roller 2 reaches a fixing temperature.

In this time, the output power of total 1200 W is used, and 500 W is supplied to the center coil 411, 500 W is supplied to the end coils 412 and 413, and 200 W is supplied to the coil 510. The power supplied to the coils 411 and 414 increases the surface temperature of the heating roller 2 suddenly to a fixing temperature. The power supplied to the coil 510 does not suddenly increase the surface temperature of the pressing roller 300 until the coils 411 and 414 reach a fixing temperature, or during the warm-up. In this embodiment, the power supplied to the coil 510 is set to 200 W so that the temperature TC detected by the thermistor 600C is kept lower than the heating roller 2, lower than 140° C., for example, until the warm-up is finished.

Therefore, the heating roller is heated to a fixing temperature, and the pressing roller 300 is heated to a temperature lower than the heating roller 2, so that the temperature TC detected by the thermistor 600C does not exceed 140° C.

Thus, when the paper sheet P passes between the heating roller 2 and the pressing roller 300, a temperature decrease of the heating roller 2 can be prevented, and an image can be fixed satisfactorily to the paper sheet P. Particularly, as in the present invention, when the thin film conductive metal layer 2*c* is used for the heating roller 2, the conductive metal layer 2*c* has small heat capacity, and a temperature decrease of the heating roller 2 causes defective image forming, when the paper sheet P passes continuously. However, in this invention, the temperature difference between the pressing roller 300 and the heating roller is decreased, and the heat shift from the heating roller 2 to the pressing roller 300 can be decreased. This is more effective for a fixing apparatus having a thin film conductive metal layer.

The similar ON/OFF control is used in the fixing apparatus shown in FIG. 20, and the heating roller 2 is heated to a fixing temperature.

Next, description will be given on the operation of the fixing apparatus after the end of warm-up with reference to FIG. 21.

Figure 21:
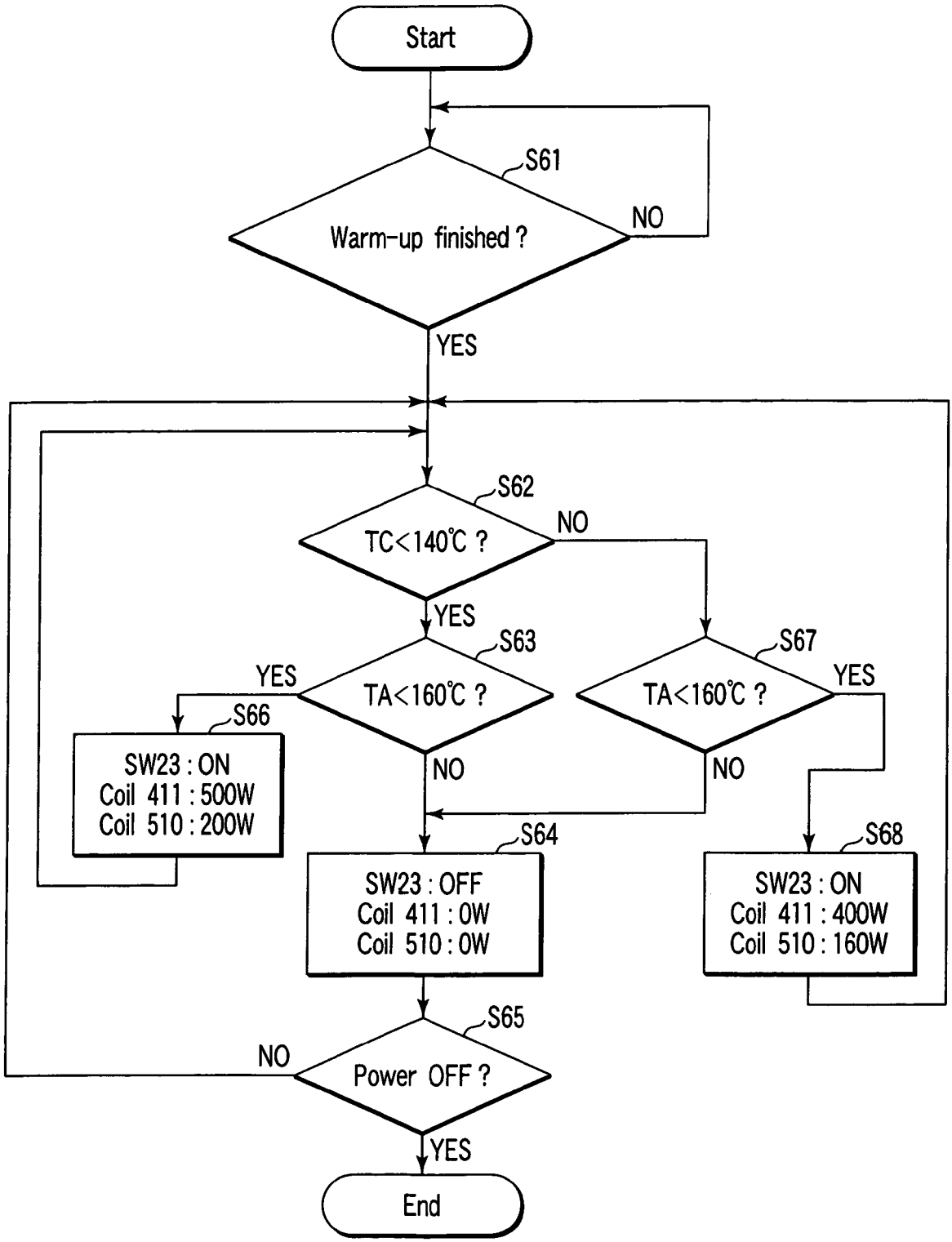
FIG. 21 is a flowchart for explaining an example of a method of controlling a switching element 23 according to a fifth embodiment.
Figure 22:
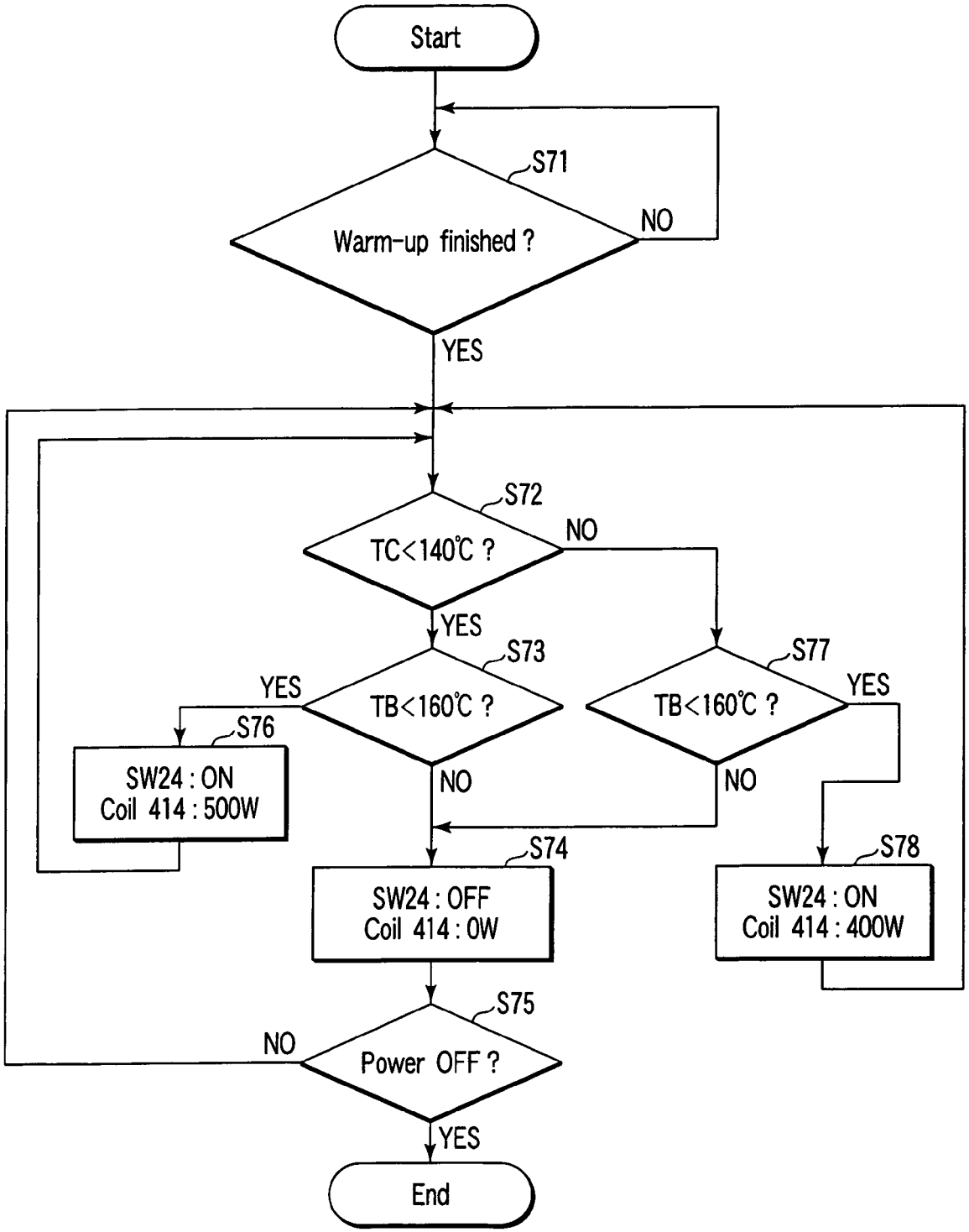
FIG. 22 is a flowchart for explaining an example of a method of controlling a switching element 24 according to a fifth embodiment.

FIG. 21 is a flowchart for explaining an example of a method of controlling ON/OFF of the switching element (SW) 23. FIG. 22 is a flowchart for explaining an example of a method of controlling ON/OFF of the switching element (SW) 24. Description will be give on the operation of the fixing apparatus connected in the second pattern shown in FIG. 20, but the control method is applicable to the fixing apparatus connected in the first pattern shown in FIG. 19.

As shown in FIG. 21, when the warm-up is finished (S61—YES), the CPU 28 checks whether the temperature information YC detected by the thermistor 600C reaches 140° C. (S62). If the temperature information YC detected by the thermistor 600C does not reach 140° C. (S62—YES), the CPU checks further whether the temperature information TA detected by the thermistor 600A reaches 160° C. (S63). If the temperature detected by the thermistor 600A reaches 160° C. (S63—NO), the CPU turns off the switching element SW23. Therefore, the power supply to the center coil 411 and coil 510 connected in series is stopped (S64). If an instruction to turn off the power of the apparatus is issued, the control is finished (S65—YES). If an instruction to turn off the power of the apparatus is not issued, the operation is returned to step S62.

When the temperature detected by the thermistor 600C is lower than 140° C. in step S62 and the temperature detected by the thermistor 600A is lower than 160° C. in step S63 (S63—YES), the CPU 28 instructs the driving circuit 31 through the control circuit 29 to generate a driving frequency to supply 500 W to the center coil 411 and 200 W to the coil 510. In this time, the switching element SW23 is in the ON state, and the operation is returned to step S62 (S66).

If the temperature detected by the thermistor 600C is over 140° C. in step S62, the CPU checks whether the temperature information TA detected by the thermistor 600A reaches 160° C. (S67). If the temperature detected by the thermistor 600A reaches 160° C. (S67—NO), the CPU turns off the switching element SW23 (S64).

If the temperature detected by the thermistor 600A is lower than 160° C. in step S67 (S67—YES), the CPU 28 instructs through the control circuit 29 the driving circuit 31 to generate a driving frequency to supply 400 W to the center coil 411 and 160 W to the coil 510. In this time, the switching element SW23 is in the ON state, and the CPU returns to step S62 (S68).

As shown in FIG. 22, when the warm-up is finished (S71—YES), the CPU 28 checks whether the temperature information TC detected by the thermistor 600C reaches 140° C. (S72). If the temperature information TC detected by the thermistor 600C does not reach 140° C. (S72—YES), the CPU checks whether the temperature information TB detected by the thermistor 600B reaches 160° C. (S73). If the temperature information TC detected by the thermistor 600B reaches 160° C. (S73—NO), the CPU turns off the switching element SW24. Therefore, the power supply to the end coil 414 comprising the end coils 412 and 413 connected in series is stopped (S74). If an instruction to turn off the power of the apparatus is issued, the CPU finishes the control (S75—YES). If an instruction to turn off the power of the apparatus is not issued, the CPU returns to step S72.

When the temperature detected by the thermistor 600C is lower than 140° C. in step S72 and the temperature detected by the thermistor 600B is lower than 160° C. in step S73 (S63—YES), the CPU 28 instructs the driving circuit 32 through the control circuit 30 to generate a driving frequency to supply 500 W to the end coil 414. In this time, the switching element SW24 is in the ON state, and the CPU returns to step S72 (S76).

If the temperature detected by the thermistor 600C is over 140° C. in step S72, the CPU checks whether the temperature information TB detected by the thermistor 600B reaches 160° C. (S77). If the temperature detected by the thermistor 600B reaches 160° C. (S77—NO), the CPU turns off the switching element SW24 (S74).

If the temperature detected by the thermistor 600B is lower than 160° C. in step S77 (S77—YES), the CPU 28 instructs through the control circuit 30 the driving circuit 32 to generate a driving frequency to supply 400 W to the end coil 414. In this time, the switching element SW24 is in the ON state, and the CPU returns to step S72 (S78).

As described above, when the thermistor 600C detects 140° C. and the pressing roller 300 is judged excessively heated, the total output power supplied to the coils 411, 414 and 510 is decreased. As the ratio of the power supplied to the coils 411, 414 and 510 is not changed, the temperature of the heating roller 2 is not suddenly decreased.

If the surface of the pressing roller 300 is so heated that the thermistor 600C detects 140° C., the surface temperature of the heating roller 2 is partially increased higher than a fixing temperature. For example, it occurs if the paper sheet P is not continuously but intermittently passed between the heating roller 2 and the pressing roller 300. This is because, the heat of the heating roller 2 is not much taken by the paper sheet P, and the heat shifts to the pressing roller 300 and the temperature of the pressing roller 300 increases.

Thus, if the paper sheet P passes between the high-temperature heating roller 2 and the pressing roller 300, the adhered toner is fused excessively causing a hot offset, and a good image is not formed.

In this embodiment, the total power supplied to the coils 411, 414 and 510 is decreased, and the surface temperatures of the heating roller 2 and the pressing roller 300 are prevented from increasing excessively. Though the total power supplied to the coils 411, 414 and 510 is decreased, the heating roller 2 has been heated sufficiently and the paper sheet P is not continuously passed, and the coils 411 and 414 are supplied with enough power to keep the surface of the heating roller 2 at a fixing temperature. Further, though the total power supplied to the coils 411, 414 and 510 is decreased, the ratio of the power supplied to the coils 411 and 414 is not changed, the surface temperature of the heating roller 2 can be controlled to be even in the axial direction.

The embodiment is not limited to the above description. If the temperature of the pressing roller 300 is not decreased lower than 140° C. when the total power supplied to the coils 411, 414 and 510 is decreased from 1200 W to 900 W, it is allowed to decrease the power supplied in steps S68 or S78 to supply power lower than 960 W to the coils 411, 414 and 510.

If the paper sheet P is continuously passed between the heating roller 2 and the pressing roller 300, or if a full-size or A3 paper sheet P is passed, the temperature of the heating roller 2 is decreased, and the temperature of the pressure roller 300 is also decreased. In this embodiment, when the temperature of the heating roller 2 is decreased, the output power to the coils 411 and 414 is increased and the output power to the coil 510 is also increased. This solves the temperature decrease problem caused by the shift of the heat of the heating roller 2 to the pressing roller 300.

Further, in this embodiment, an inverter circuit is not provided for the second induction heater 500 to heat the pressing roller 300, and the cost is reduced.

The embodiments 4 and 5 have been explained by using a fixing apparatus of the type that a paper sheet P passes through the center of the heating roller 2 as shown in FIGS. 17 and 18. The invention is not limited to this type. It is possible to use a fixing apparatus of the type shown in FIG. 23.

Figure 23:
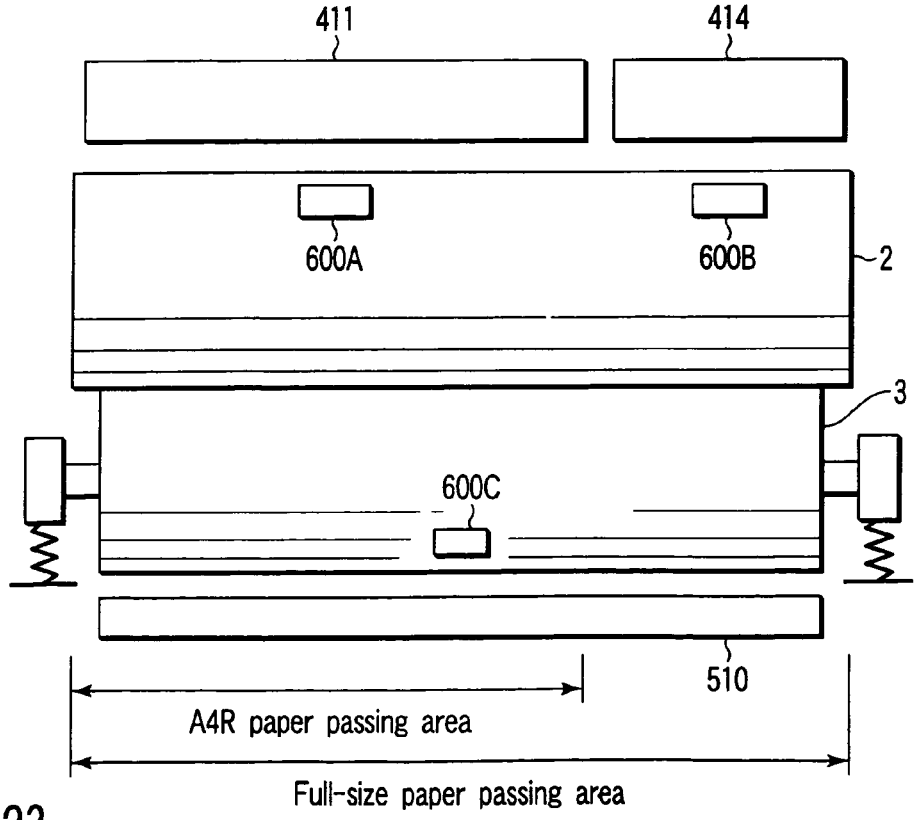
FIG. 23 is a schematic diagram showing another example of a fixing apparatus applicable to the present invention.

The fixing apparatus shown in FIG. 23 is of the type in which the end of paper sheet P passes along the end of the heating roller 2. In detail, the first induction heater 400 to heat the heating roller 2 includes the center coil 411 which heats the area to pass a small A4R paper sheet P, and the end coil 411 is placed outside the area adjacent to the center coil 411, and heats the area to pass a full-size paper sheet P together with the center coil 411. The coil 510 is placed outside the pressing roller 300. The thermistor 600A detects the temperature of the area heated by the center coil 411. The thermistor 600B detects the temperature of the area heated by the end coil 414. The thermistor 600C detects the temperature of the area heated by the coil 510.

As described above, according to the invention, a high-frequency current can be flowed in a plurality of coils by using a self-excited inverter circuit. Thus, the number of switching elements can be decreased compared with a fixing apparatus using a separately excited inverter circuit. This improves the heating efficiency, and reduces the cost.

Further, though a high-frequency current is flowed simultaneously in a plurality of coils by using a self-excited inverter circuit, interference noise is prevented by making the difference between the maximum frequency of one coil and the minimum frequency of the other coil out of an audible frequency range.

Further, in the present invention, a circuit to control an induction heating means to heat a pressing roller is compatible with a circuit to control an induction heating means to heat a heating roller. This prevents rising of cost.

Further, if the heating roller temperature is decreased by heating the pressing roller, the decrease of temperature is compensated for by the temperature of the pressing roller, and a temperature decrease of the heating roller during passage of a paper sheet can be improved.

What is claimed is:

1. A fixing apparatus comprising:

a heating member having a conductive metal layer;

a pressing member to supply a pressure to the heating member;

an induction heater which includes a first coil placed outside the heating member, and a second coil which is placed outside the heating member and has an inductance different from the first coil, and heats the conductive metal layer of the heating member by induction heating; and an induction heating control circuit which includes a first self-excited inverter circuit to flow a high-frequency current variable in a first frequency range in the first coil, and a second self-excited inverter circuit to flow a high-frequency current variable in a second frequency range in the second coil, and controls the first and second self-excited inverter circuits to flow a high-frequency current simultaneously in the first and second coils and to vary the frequency of the high-frequency current in the first and second coils in the first and second frequency ranges, respectively, so as to control a temperature of the conductive metal layer;

wherein the first frequency range is smaller than the second frequency range, and the difference between the maximum value of the first frequency range and the minimum value of the second frequency range is out of an audible frequency range.

2. The fixing apparatus according to claim 1, wherein the number of turns of the first coil is different from the number of turns of the second coil.

3. The fixing apparatus according to claim 1, wherein when a high-frequency current flow simultaneously in the first and second coils, the power supplied to the first coil is equal to the power supplied to the second coil.

4. The fixing apparatus according to claim 1, wherein the first coil is placed opposite to the center area of the heating member, and the second coil is placed opposite to the end areas of the heating member.

5. A fixing apparatus comprising:

a heating member having a conductive metal layer;

a pressing member to supply a pressure to the heating member;

an induction heater which includes a first coil placed outside the heating member, and a second coil which is placed outside the heating member and has an inductance different from the first coil, and heats the conductive metal layer of the heating member by induction heating; and an induction heating control circuit which includes a first self-excited inverter circuit to flow a high-frequency current having a first frequency range in the first coil, a second self-excited inverter circuit to flow a high-frequency current having a second frequency range in the second coil, and controls to flow a high-frequency current simultaneously in the first and second coils;

wherein the first frequency range is not equal to the second frequency range, and a capacity of a resonance condenser included in the first self-excited inverter circuit is different from a capacity of a resonance condenser included in the second self-excited inverter circuit.

6. A fixing apparatus comprising:

a heating member having a conductive metal layer;

a pressing member to supply a pressure to the heating member;

an induction heater which includes a first coil placed outside the heating member, and a second coil which is placed outside the heating member and has an inductance different from the first coil, and heats the conductive metal layer of the heating member by induction heating; and an induction heating control circuit which includes a first self-excited inverter circuit to flow a high frequency current having a first frequency range in the first coil, a second self-excited inverter circuit to flow a high-frequency current having a second frequency range in the second coil, and controls to flow a high-frequency current simultaneously in the first and second coils;

wherein the first frequency range is not equal to the second frequency range, and the distance from the first coil to the heating member is different from the distance from the second coil to the heating member.

7. A fixing apparatus comprising:

a heating member having a conductive metal layer;

a pressing member to supply a pressure to the heating member;

an induction heater which includes a first coil placed outside the heating member, and a second coil which is placed outside the heating member and has an inductance different from the first coil, and heats the conductive metal layer of the heating member by induction heating; and an induction heating control circuit which includes a first self-excited inverter circuit to flow a high-frequency current having a first frequency range in the first coil, a second self-excited inverter circuit to flow a high-frequency current having a second frequency range in the second coil, and controls to flow a high-frequency current simultaneously in the first and second coils;

wherein the first frequency range is not equal to the second frequency range, and a length of a magnetic material core provided on a winding axis of the first coil in a direction orthogonal to an axial direction of the heating member on the surface opposite to the heating member is different from a length of a magnetic material core provided on a winding axis of the second coil in a direction orthogonal to an axial direction of the heating member on the surface opposite to the heating member.

8. A fixing apparatus comprising:

a heating member having a conductive metal layer;

a pressing member to supply a pressure to the heating member;

an induction heater which includes a first coil placed outside the heating member, and a second coil which is placed outside the heating member and has a load resistance equal to the inductance of the first coil, and heats the conductive metal layer of the heating member by induction heating; and an induction heating control circuit which includes a first self-excited inverter circuit to flow a high-frequency current in the first coil, a second self-excited inverter circuit to flow a high-frequency current in the second coil, and controls to flow a high-frequency current with substantially equal frequency simultaneously in the first and second coils.

9. The fixing apparatus according to claim 8, wherein the number of turns of the first coil is different from the number of turns of the second coil.

10. The fixing apparatus according to claim 8, wherein the difference between the frequency of the high-frequency current flowing in the first coil and the frequency of the high-frequency current flowing in the second coil is out of an audible frequency range.

11. The fixing apparatus according to claim 10, wherein when a high-frequency current flow simultaneously in the first and second coils, the power supplied to the first coil is equal to the power supplied to the second coil.

12. The fixing apparatus according to claim 8, wherein the difference between the high-frequency current flowing in the first coil and the frequency of the high-frequency current flowing in the second coil is within 200 Hz.

13. The fixing apparatus according to claim 8, wherein the shape of a litz wire included in the first coil is different from the shape of a litz wire included in the second self-excited inverter circuit.

14. The fixing apparatus according to claim 8, wherein the area of the first coil facing the heating member is different from the area of the second coil facing the heating member.

15. The fixing apparatus according to claim 8, wherein the length of a magnetic material core provided on the winding axis of the first coil in the direction orthogonal to the axial direction of the heating member on the surface opposite to the heating member is different from the length of a magnetic material core provided on the winding axis of the second coil in the direction orthogonal to the axial direction of the heating member on the surface opposite to the heating member.

16. A fixing apparatus comprising:

a heating member having a conductive metal layer;

a pressing member to supply a pressure to the heating member;

an induction heater which includes a first coil placed outside the heating member, and a second coil placed outside the heating member, and heats the conductive metal layer of the heating member by induction heating; and an induction heating control circuit which includes a first self-excited inverter circuit to flow a high-frequency current in the first coil, a second self-excited inverter circuit to flow a high-frequency current in the second coil, and controls to flow a high-frequency current with substantially equal frequency simultaneously in the first and second coils;

wherein when a high-frequency current flows simultaneously in the first and second coils, the power supplied to the first coil is equal to the power supplied to the second coil.

17. The fixing apparatus according to claim 16, wherein when both the first and second coils are turned on from the off state, the power supplied to the first coil is equal to the power supplied to the second coil, and the power supplied to the first and second coils is gradually increased.

18. A fixing apparatus comprising:

a heating member having a conductive metal layer;

a pressing member which has a conductive metal layer, and supplies a pressure to the heating member;

a first induction heater which includes a first coil placed outside the heating member, and a second coil arranged in rows at one end of the first coil, a third coil arranged in rows at the other end of the first coil and connected in series with the second coil, and heats the conductive metal layer of the heating member by induction heating;

a second induction heater which includes a fourth coil placed outside the pressing member and connected in series with the second and third coils, and heats the conductive metal layer of the pressing member by induction heating; and an induction heating control circuit which includes a first self-excited inverter circuit to flow a high-frequency current in the first coil, second and third coils connected in series, and a second self-excited inverter circuit which flows a high-frequency current in the fourth coil.

19. The fixing apparatus according to claim 18, wherein the sum of the power supplied to the second and third coils is larger than the power supplied to the fourth coil.

20. The fixing apparatus according to claim 19, wherein the induction heating control circuit is connected with (i) a first temperature detection member to detect the temperature of the heating member heated by the first coil, a second temperature detection member to detect the temperature of the heating member heated by the second coil, and a fourth temperature detection member to detect the temperature of the heating member heated by the fourth coil, (ii) receives the signal including the information about the detected temperature, (iii) stops the power supplied to the first coil when the temperature detected by the first temperature detection member is higher than a control temperature, and supplies power to the first coil when the temperature detected by the first temperature detection member is lower than a control temperature, (iv) stops the power supplied to the second to fourth coils when the temperature detected by the second temperature detection member is higher than a control temperature, and supplies power to the second to fourth coils when the temperature detected by the second temperature detection member is lower than a control temperature, and (v) decreases the power supplied to the first to fourth coils when the temperature detected by the fourth temperature detection member is higher than a control temperature, and increases the power supplied to the first to fourth coils when the temperature detected by the fourth temperature detection member is lower than a control temperature.

* * * * *